US010088789B2

(12) United States Patent
Onishi et al.

(10) Patent No.: US 10,088,789 B2
(45) Date of Patent: Oct. 2, 2018

(54) BELT, TRANSFER BELT UNIT, AND IMAGE FORMING APPARATUS

(71) Applicant: Oki Data Corporation, Tokyo (JP)

(72) Inventors: Akihito Onishi, Tokyo (JP); Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/159,408

(22) Filed: May 19, 2016

(65) Prior Publication Data

US 2016/0378036 A1 Dec. 29, 2016

(30) Foreign Application Priority Data

Jun. 26, 2015 (JP) ..... 2015-128293
Sep. 30, 2015 (JP) ..... 2015-192429

(51) Int. Cl.
*G03G 15/00* (2006.01)
*G03G 15/16* (2006.01)

(52) U.S. Cl.
CPC ..... *G03G 15/5054* (2013.01); *G03G 15/162* (2013.01); *G03G 15/1615* (2013.01)

(58) Field of Classification Search
CPC ..... G03G 15/5054; G03G 15/161; G03G 15/1615; G03G 2215/0016; G03G 15/162; B65G 39/16
See application file for complete search history.

(56) References Cited

U.S. PATENT DOCUMENTS 5,536,607 A * 7/1996 Ohashi ..... G03G 5/10 347/139
5,701,569 A * 12/1997 Kanazawa ..... G03G 15/1675 399/308
5,896,158 A * 4/1999 Brenner, Jr. ..... G03G 15/755 347/116
2001/0022899 A1* 9/2001 Castelli ..... G03G 15/0152 399/9
2005/0238371 A1* 10/2005 Sudo ..... G03G 15/161 399/38
2007/0092308 A1 4/2007 Miyamoto et al.
2008/0063957 A1* 3/2008 Murakami ..... G03G 15/0812 430/48
2008/0213009 A1* 9/2008 Kamoshita ..... G03G 15/0131 399/313
2009/0297189 A1* 12/2009 Saiki ..... G03G 15/1605 399/49
2010/0003037 A1* 1/2010 Kerxhalli ..... G03G 15/1605 399/9
2010/0040393 A1* 2/2010 Kawahara ..... G03G 15/0131 399/101
2010/0203993 A1* 8/2010 Matsukawa ..... F16G 5/20 474/251
2010/0232819 A1* 9/2010 Kudo ..... B65G 39/16 399/66

(Continued)

FOREIGN PATENT DOCUMENTS

JP H06-056292 A 3/1994

*Primary Examiner* — Carla Therrien
(74) *Attorney, Agent, or Firm* — Rabin & Berdo, P.C.

(57) ABSTRACT

A belt has an endless shape, and is driven to rotate by a driving roller provided on an inner side thereof. The belt includes a detection target portion on an outer surface at an end of the belt in a widthwise direction of the belt. The detection target portion includes an uneven pattern.

18 Claims, 17 Drawing Sheets

(56) References Cited

U.S. PATENT DOCUMENTS

2011/0229159 A1* 9/2011 Kiryu ..... G03G 15/161
399/31
2013/0258352 A1* 10/2013 Fukuhara ..... G01B 11/14
356/614

* cited by examiner

FIG. 10

| | BELT COMPOSITION | MARK FORIMING METHOD | VISUAL REFLECTANCE DIFFERENCE Δ Y (%) | TONER SMEAR | DURABILITY | EVALUATION RESULT |
|---|---|---|---|---|---|---|
| EXAMPLE 1 | PAI | LASER | 3.8 | ○ | ○ | ○ |
| EXAMPLE 2 | PVDF/ URETHANE RUBBER/ URETHANE RESIN | LASER | 18 | ○ | ○ | ○ |
| COMPARISON EXAMPLE 1 | PAI | MOLDING | 0.6 | ○ | ○ | × |
| COMPARISON EXAMPLE 2 | PAI | GRINDING | -0.2 | ○ | × | × |
| COMPARISON EXAMPLE 3 | PAI | RESIN COATING | 0.3 | △ | × | × |

FIG. 11

| | DENSITY OF GROOVES | DEPTH OF GROOVE ( μm ) | VISUAL REFLECTANCE DIFFERENCE Δ Y (%) | TONER SMEAR | EVALUATION RESULT |
|---|---|---|---|---|---|
| SAMPLE BELT A | LOW | 10 | 0.7 | ○ | × |
| SAMPLE BELT B | INTERMEDIATE | 10 | 1.6 | ○ | ○ |
| EXAMPLE 1 | HIGH | 10 | 3.8 | ○ | ○ |
| SAMPLE BELT C | HIGH | 13 | 8 | △ | ○→△ |
| SAMPLE BELT D | HIGH | 16 | 10 | × | ○→× |

FIG. 12

| | IRRADIATION AMOUNT | VISUAL REFLECTANCE DIFFERENCE Δ Y (%) | HEIGHT OF CONVEX (μ m) | DEPTH OF CONCAVE (μ m) | VISUAL REFLECTANCE |
|---|---|---|---|---|---|
| NON-MARK PORTION | NONE | – | – | – | 0.9( Yr) |
| SAMPLE BELT E | +20% | 3.63 | 2.5 | 0.3 | 4. 53( Yp) |
| SAMPLE BELT F | 0% (REFERENCE) | 3.39 | 2.2 | 1.6 | 4. 29( Yp) |
| SAMPLE BELT G | - 20% | 3.31 | 1.5 | 1.5 | 4. 21( Yp) |
| SAMPLE BELT H | - 40% | 3.52 | 1.9 | 3.3 | 4. 42( Yp) |
| SAMPLE BELT I | - 60% | 3.66 | 1.9 | 5.6 | 4. 56( Yp) |
| SAMPLE BELT J | - 80% | 0.98 | 1.9 | – | 1. 88( Yp) |

FIG. 21

| | HEIGHT DIFFERENCE (μm) | | LIGHT RECEPTION VOLTAGE (V) | | | EVALUATION |
|---|---|---|---|---|---|---|
| | MARK CONTOUR PORTION dg | MARK CENTER PORTION dc | NON MARK PORTION | MARK PORTION | DIFFERENCE ΔV1 (%) | |
| COMPARISON EXAMPLE 11 | 14.3 | 12.3 | 2.7 | 0.63 | 2.07 | ▲ |
| EXAMPLE 11 | 10.2 | 8.6 | 2.7 | 0.7 | 2.00 | ○ |
| EXAMPLE 12 | 7.6 | 4.3 | 2.7 | 0.7 | 2.02 | ○ |
| EXAMPLE 13 | 5.5 | 3.2 | 2.7 | 1.1 | 1.58 | ○ |
| EXAMPLE 14 | 5.1 | 2.6 | 2.7 | 0.9 | 1.78 | ○ |
| EXAMPLE 15 | 3.2 | 2.0 | 2.7 | 1.2 | 1.51 | ○ |
| EXAMPLE 16 | 7.8 | 8.0 | 2.7 | 0.7 | 2.00 | ○/□ |
| COMPARISON EXAMPLE 12 | 2.8 | 1.7 | 2.7 | 1.8 | 0.88 | △ |
| COMPARISON EXAMPLE 13 | 2.1 | 1.0 | 2.7 | 1.9 | 0.77 | △ |

FIG. 23

| | SIZE (mm) | | LIGHT RECEPTION VOLTAGE (V) | | | DETECTION LENGTH (mm) | EVALUATION |
|---|---|---|---|---|---|---|---|
| | WIDTH Wd | LENGTH LD | NON MARK PORTION | MARK PORTION | DIFFERENCE ΔV1 (%) | | |
| COMPARISON EXAMPLE 14 | 7 | 1 | 2.7 | 2.0 | 0.7 | 0.1 | × |
| EXAMPLE 17 | 7 | 2 | 2.7 | 1.3 | 1.4 | 1.3 | △ |
| EXAMPLE 18 | 7 | 3 | 2.7 | 1.2 | 1.5 | 2.2 | ▲ |
| EXAMPLE 19 | 7 | 4 | 2.7 | 1.1 | 1.6 | 3.2 | ▲ |
| EXAMPLE 20 | 7 | 5 | 2.7 | 1.1 | 1.6 | 4.3 | ○ |
| EXAMPLE 21 | 7 | 6 | 2.7 | 1.1 | 1.6 | 5.1 | ○ |
| EXAMPLE 22 | 7 | 7 | 2.7 | 1.1 | 1.6 | 6.1 | ○ |
| EXAMPLE 23 | 7 | 8 | 2.7 | 1.1 | 1.6 | 7.0 | ○ |
| EXAMPLE 24 | 7 | 10 | 2.7 | 1.1 | 1.6 | 7.3 | ○ |
| EXAMPLE 25 | 7 | 13 | 2.7 | 1.1 | 1.6 | 7.5 | ○ |
| EXAMPLE 26 | 7 | 15 | 2.7 | 1.1 | 1.6 | 11.9 | ○ |
| COMPARISON EXAMPLE 15 | 7 | 20 | 2.7 | 1.1 | 1.6 | 15.7 | ▲/□ |

FIG. 24

| | SIZE (mm) | | LIGHT RECEPTION VOLTAGE (V) | | | EVALUATION |
|---|---|---|---|---|---|---|
| | WIDTH Wd | LENGTH LD | ONE TURN ΔV1 (%) | MINIMUM ΔV2 (%) | DIFFERENCE ΔV3 (%) | |
| COMPARISON EXAMPLE 16 | 2 | 7 | 0.8 | 0.4 | 0.4 | × |
| EXAMPLE 27 | 4 | 7 | 1.5 | 1.0 | 0.5 | ○ |
| EXAMPLE 28 | 5 | 7 | 1.6 | 1.2 | 0.4 | ○ |
| EXAMPLE 29 | 6 | 7 | 1.6 | 1.6 | – | ◎ |
| EXAMPLE 30 | 7 | 7 | 1.6 | 1.6 | – | ◎ |
| EXAMPLE 31 | 8 | 7 | 1.6 | 1.6 | – | ◎ |
| EXAMPLE 32 | 10 | 7 | 1.6 | 1.6 | – | ◎ |
| EXAMPLE 33 | 15 | 7 | 1.6 | 1.6 | – | ◎ |
| COMPARISON EXAMPLE 17 | 20 | 7 | 1.6 | 1.5 | 0.1 | ◎/□ |

FIG. 26

| | DISTANCE D1 (mm) | EVALUATION |
|---|---|---|
| COMPARISON EXAMPLE 18 | 0 | × |
| COMPARISON EXAMPLE 19 | 0.5 | × |
| EXAMPLE 34 | 1.0 | △ |
| EXAMPLE 35 | 1.5 | △ |
| EXAMPLE 36 | 2.0 | ○ |
| EXAMPLE 37 | 2.5 | ○ |
| EXAMPLE 38 | 5.0 | ○/□ |

BELT, TRANSFER BELT UNIT, AND IMAGE FORMING APPARATUS

BACKGROUND OF THE INVENTION

The present invention relates to a belt including a detection target portion, a transfer belt unit and an image forming apparatus using the belt.

In electrophotographic image forming apparatuses, a plurality of belt-like transfer members such as an intermediate transfer belt and a transfer belt are used.

For example, in a color image forming apparatus, a position of the belt-like transfer member is controlled with high accuracy in order to prevent displacement of toner images of respective colors (for example, yellow, magenta, cyan, black or the like). Further, in a printer using a continuous recording medium such as a rolled paper, the position of the belt-like transfer member is controlled with high accuracy in order to prevent displacement of a writing starting position due to extension or speed variation of the belt-like transfer member.

In order to control the position of the belt-like transfer member with high accuracy, there is proposed an image forming apparatus including a belt-like transfer member on which a position detection mark is formed. A position and speed of the belt-like transfer member is controlled by detecting the position detection mark formed on the belt-like transfer member using a position detection unit. The position detection mark is formed of an adhesive tape bonded to the belt-like transfer member. The adhesive tape reflects or absorbs light (see, for example, Japanese Application Publication No. H6-56292).

However, there are cases where the position detection mark separates from the belt-like transfer member when an adhesive force decreases.

SUMMARY OF THE INVENTION

An aspect of the present invention is intended to reduce separation of a detection target portion.

According to an aspect of the present invention, there is provided a belt having an endless shape and driven to rotate by a driving roller provided on an inner side thereof. The belt includes a detection target portion on an outer surface at an end of the belt in a widthwise direction of the belt. The detection target portion includes an uneven pattern.

According to another aspect of the present invention, there is provided a belt having an endless shape and driven to rotate by a driving roller provided on an inner side thereof. The belt includes a detection target portion on an outer surface at an end of the belt in a widthwise direction of the belt. The detection target portion is formed by modifying a part of the outer surface so that a difference ΔY obtained by subtracting a visual reflectance Yr of an outer surface of the belt other than the detection target portion from a visual reflectance Yp of the detection target portion satisfies:

$$\Delta Y = Yp - Yr > 0.$$

According to still another aspect of the present invention, there is provided a transfer belt unit including the above described belt, the driving roller provided on the inner side of the belt and driving the belt, a supporting roller provided on the inner side of the belt and applying tension to the belt, and a transfer roller that transfers a developer image to the belt.

According to yet another aspect of the present invention, there is provided an image forming apparatus including the above described transfer belt unit, an image forming unit that forms the developer image to be transferred to the belt, a secondary transfer roller that secondarily transfers the developer image from the belt to a recording medium, a detector that detects the detection target portion of the belt, and a controller that controls a rotation of the driving roller based on information of detection by the detector.

With such a configuration, it becomes possible to reduce separation of the detection target portion from the belt.

BRIEF DESCRIPTION OF THE DRAWINGS

In the attached drawings:

FIG. 10 is a table showing results of a detection test 1;

FIG. 11 is a table showing results of a detection test 2;

FIG. 12 is a table showing results of a detection test 3;

FIG. 21 is a table showing results of a detection test 4;

FIG. 23 is a table showing results of a detection test 5;

FIG. 24 is a table showing results of a detection test 6;

FIG. 26 is a table showing results of a detection test 7.

DETAILED DESCRIPTION OF THE PREFERRED EMBODIMENT

First Embodiment

Figure 1:
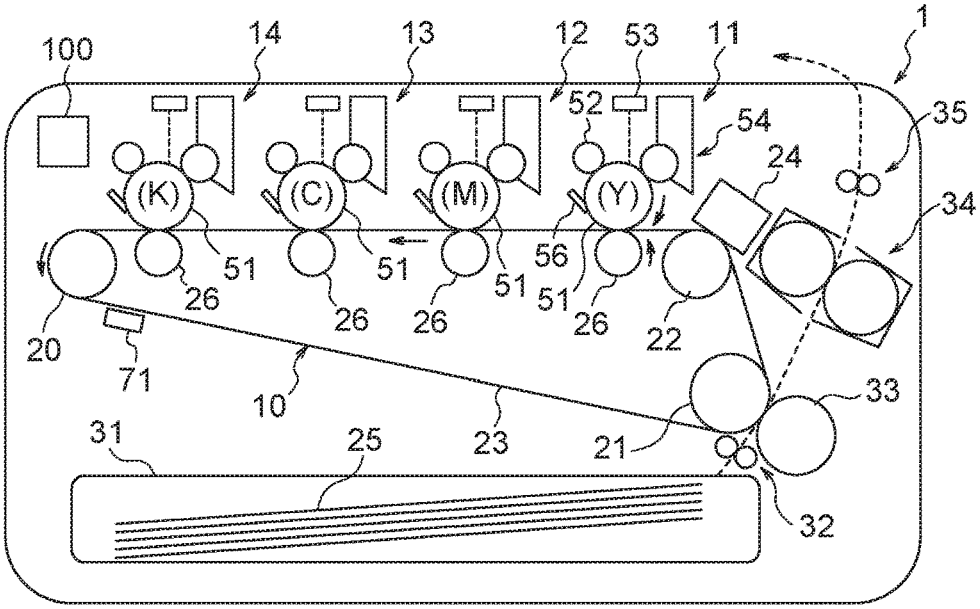
FIG. 1 is a schematic view showing a configuration of an image forming apparatus including a transfer belt according to the first embodiment of the present invention.

FIG. 1 is a schematic view showing a configuration of an image forming apparatus 1 including a transfer belt 23 according to the first embodiment of the present invention.

The image forming apparatus 1 shown in the FIG. 1 is configured as an electrophotographic color printer of an intermediate transfer type. The image forming apparatus 1 includes a detachably attached medium cassette 31 storing recording media 25 such as recording sheets. The image forming apparatus 1 further includes a feed roller (not shown) configured to feed the recording medium 25 from the medium cassette 31, and conveying rollers 32 configured to convey the recording medium 25 to a secondary transfer portion. The image forming apparatus 1 further includes image forming units 11, 12, 13 and 14 configured to form toner images (i.e., developer images) of yellow (Y), magenta (M), cyan (C) and black (K). The image forming units 11, 12, 13 and 14 are arranged in this order from upstream to downstream along a moving direction (shown by an arrow in FIG. 1) of the transfer belt 23 as a belt having an endless shape. The image forming units 11, 12, 13 and 14 respectively include photosensitive drums 51 contacting the transfer belt 23. The image forming units 11, 12, 13 and 14 have the same configuration except for the toners to be used.

The image forming units 11, 12, 13 and 14 will be described with an example of the image forming unit 11 of yellow. Each of the image forming units 11, 12, 13 and 14 includes a photosensitive drum 51 (i.e., a latent image bearing body), a charging roller 52 (i.e., a charging member) that uniformly charges a surface of the photosensitive drum 51 by supplying electric charge thereto, an LED head 53 (i.e., an exposure unit) that emits light to expose the surface of the photosensitive drum 51 based on image data so as to form an electrostatic latent image, a developing unit 54 that develops the latent image on the surface of the photosensitive drum 51 with toner to form a toner image (i.e., a developer image), and a cleaning blade 56 disposed so as to contact the surface of the photosensitive drum 51 to remove a residual toner remaining thereon.

The image forming apparatus 1 further includes a transfer belt unit 10. The transfer belt unit 10 includes a transfer belt 23 as a belt having an endless shape (i.e., an endless belt), and a driving roller 20 driven to rotate by an actuator (not shown) and driving the transfer belt 23 in a direction shown by the arrow. The transfer belt unit 10 further includes supporting rollers 21 and 22. The transfer belt 23 is stretched around the supporting rollers 21 and 22 and the driving roller 20 in such a manner that a predetermined tension is applied to the transfer belt 23. The transfer belt unit 10 further includes primary transfer rollers 26 as primary transfer members disposed so as to face the photosensitive drums 51 via the transfer belt 23. A movement of the transfer belt 23 around the driving roller 20 and the supporting rollers 21 and 22 as shown by the arrow may also be referred to as a "rotation" of the transfer belt 23.

A secondary transfer roller 33 as a secondary transfer member is provided so as to face the supporting roller 21 via the transfer belt 23. The secondary transfer roller 33 secondarily transfers the toner image (having been primarily transferred to the transfer belt 23) to the recording medium 25. A cleaning member 24 is disposed so as to face the supporting roller 22 via the transfer belt 23. The cleaning member 24 cleans the surface of the transfer belt 23 by removing a residual toner adhering to the transfer belt 23. The image forming apparatus 1 further includes a fixing device 34 configured to fix the toner image to the recording medium 25 by application of heat and pressure, and conveying rollers 35 configured to eject the recording medium 25 with the fixed toner image to outside the image forming apparatus 1.

A printing operation (i.e., image formation) of the image forming apparatus 1 having the above described configuration will be described. In this regard, an arrow shown by a dashed line in FIG. 1 indicates a conveying direction of the recording medium 25.

In each image forming units 11, 12, 13 and 14, the surface of the photosensitive drum 51 is uniformly charged by the charging roller 52 applied with a charging voltage by a power source (not shown). Then, when a charged part of the surface of the photosensitive drum 51 reaches a position facing the LED head 53 by the rotation of the photosensitive drum 51 (as shown by an arrow), the LED head 53 emits light to expose the surface of the photosensitive drum 51 so as to form an electrostatic latent image. The latent image is developed by the developing unit 54, and a toner image is formed on the surface of the photosensitive drum 51.

When the toner image on the photosensitive drum 51 passes through a primary transfer position where the photosensitive drum 51 contacts the transfer belt 23, the toner image is primarily transferred to the transfer belt 23 by the primary transfer roller 26 applied with a primary transfer voltage by a power source (not shown). Timings at which the toner images are formed on the photosensitive drums 51 are controlled so that toner images of respective colors are transferred to the transfer belt 23 in an overlapping manner. A color image is formed by toner images of yellow, magenta, cyan and black formed on the transfer belt 23.

In parallel with transfer of the color image to the transfer belt 23, the recording medium 25 stored in the medium cassette 31 is fed out therefrom by the feed roller (not shown), and is conveyed by the conveying rollers 32 to reach a contact portion between the secondary transfer roller 33 and the transfer belt 23, i.e., a secondary transfer position. When the recording medium 25 passes through the secondary transfer position, the toner image (i.e., the color image) on the transfer belt 23 is transferred to a predetermined position on the recording medium 25 by the secondary transfer roller 33 applied with a secondary transfer voltage by a power source.

Then, the recording medium 25 with the transferred toner image (i.e., the color image) is conveyed by a not shown conveying unit to the fixing device 34. The toner is molten and is fixed to the recording medium 25 by being heated and pressed by the fixing device 34. Then, the recording medium 25 with the fixed toner image is conveyed by the conveying roller 35 to a stacker portion (not shown) disposed outside the image forming apparatus 1. After the recording medium 25 separates from the transfer belt 23, the cleaning member 24 cleans the transfer belt 23 by removing the toner and other contamination from the transfer belt 23.

Figure 2:
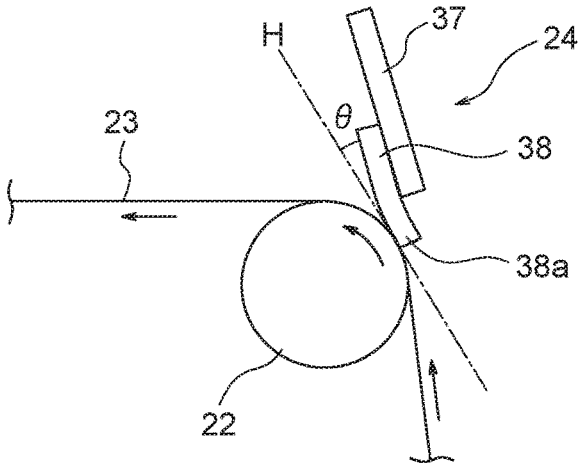
FIG. 2 is an enlarged view showing a configuration of a cleaning member shown in FIG. 1 together with a supporting roller facing the cleaning member.

FIG. 2 is an enlarged view showing a configuration of the cleaning member 24 shown in FIG. 1 together with the supporting roller 22 facing the cleaning member 24.

As shown in FIG. 2, the cleaning member 24 includes a blade 38 and a supporting member 37 that holds the blade 38. The blade 38 is fixed by the supporting member 37 with respect to a main body of the image forming apparatus 1 so that the blade 38 is pressed against the supporting roller 22 via the transfer belt 23. The blade 38 is preferably composed of a resilient body having a rubber hardness (JIS-A hardness) in a range from 65 to 100 degrees. In a particular example, the blade 38 is composed of urethane rubber having a thickness of 2.0 mm, and a JIS-A hardness of 78 degrees. This is because the blade 38 formed of a resilient body such as urethane rubber exhibits excellent performance in cleaning the residual toner and contaminations on the transfer belt 23, can be simple and compact in structure, and can be manufactured at low cost. In this regard, the blade 38 is held so that the blade 38 extends toward the supporting roller 22 from downstream in a rotating direction of the transfer belt 23.

Further, in a particular example, the blade 38 is held by the supporting member 37 so that a contact angle θ is 21 degrees, and a linear pressure is 4.3 g/mm. The contact angle θ is preferably in a range from 20 to 30 degrees, and more preferably in a range from 20 to 25 degrees. The linear pressure is preferably in a range from 1 to 6 g/mm, and more preferably in range from 2 to 5 g/mm. In this regard, the contact angle θ is an angle between an end portion 38*a* of the blade 38 and a tangential line H at a contact portion where the end portion 38*a* contacts the surface of the transfer belt 23.

In this regard, the cleaning member 24 is disposed so that the end portion 38*a* of the blade 38 contacts the transfer belt 23 at a position on the supporting roller 22. However, this embodiment is not limited to such an arrangement. For example, the cleaning member 24 may also be disposed so that the end portion 38*a* of the blade 38 contacts a part of the transfer belt 23 that moves straightly.

The transfer belt 23 of the first embodiment has a single-layer structure, and is composed of polyamide imide (PAI). In this regard, the transfer belt 23 is not limited to PAI. For example, the transfer belt 23 may be composed of polyimide (PI), polyether imide (PEI), polyphenylene sulphide (PPS), polyetheretherketone (PEEK), polyvinylidene fluoride (PVDF), polyamide (PA), polycarbonate (PC), or polybutylene terephthalate (PBT), alone or in combination.

Further, the resin is added with conductive material (i.e., electrically conductive material). The conductive material may be conductive carbon, ion conductive agent, conductive polymer or the like. Particularly, carbon black is suitable. Carbon black may be, for example, furnace carbon black, channel carbon black, acetylene carbon black or the like, but not limited to these material.

Figure 3:
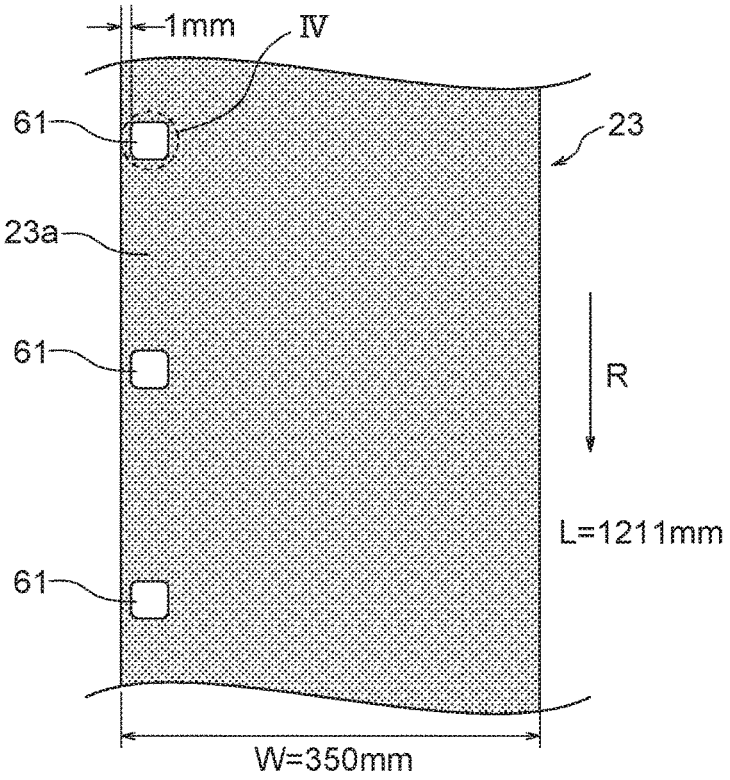
FIG. 3 is a plan view showing a part of a transfer belt according to the first embodiment, in which an arrow shows a rotating direction of the transfer belt.
Figure 4:
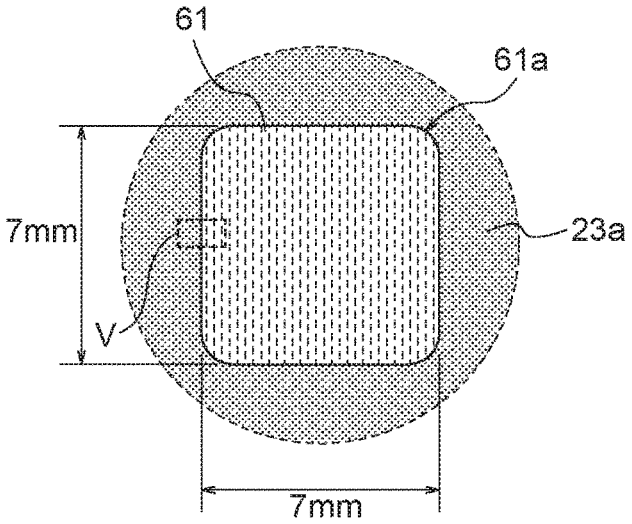
FIG. 4 is an enlarged view of a part surrounded by a circle IV shown by a chain line in FIG. 3 including a portion where a position detection mark is formed.

A configuration of the transfer belt 23 will be described. FIG. 3 is a plan view of a part of the transfer belt 23 having an endless shape. In FIG. 3, an arrow R shows a rotating direction of the transfer belt 23. For example, the transfer belt 23 has a width W of 350 mm, a circumferential length L of 1211 mm, and a thickness of 80 μm. FIG. 4 is an enlarged view of a part surrounded by a circle IV shown by a chain line in FIG. 3 where a position detection mark 61 is formed.

As shown in FIGS. 3 and 4, a plurality of position detection marks 61 (i.e., detection target portions) are formed on an outer surface 23*a* of the transfer belt 23. The position detection marks 61 are disposed at an end portion of the transfer belt 23 in a widthwise direction of the transfer belt 23, and are disposed outside a printing area in the widthwise direction so as not to interfere with printing. Each position detection mark 61 has a square shape of 7 mm×7 mm, and is distanced from an edge of the transfer belt 23 in the widthwise direction by an amount of 1 mm. However, the shape and position of the position detection mark are not limited to these examples, but may be appropriately modified.

Although the number of the position detection mark(s) 61 may be 1, it is preferable to provide a plurality of position detection marks 61 at equal intervals (or equal pitches) along the rotating direction of the transfer belt 23 (i.e., a circumferential direction of the transfer belt 23). An extension and a speed variation of the transfer belt 23 can be calculated based on a distance between adjacent position detection marks 61. Therefore, it is preferable that the interval between the position detection marks 61 is short, so that a color shift and a writing starting position can be controlled accurately.

Figure 5:
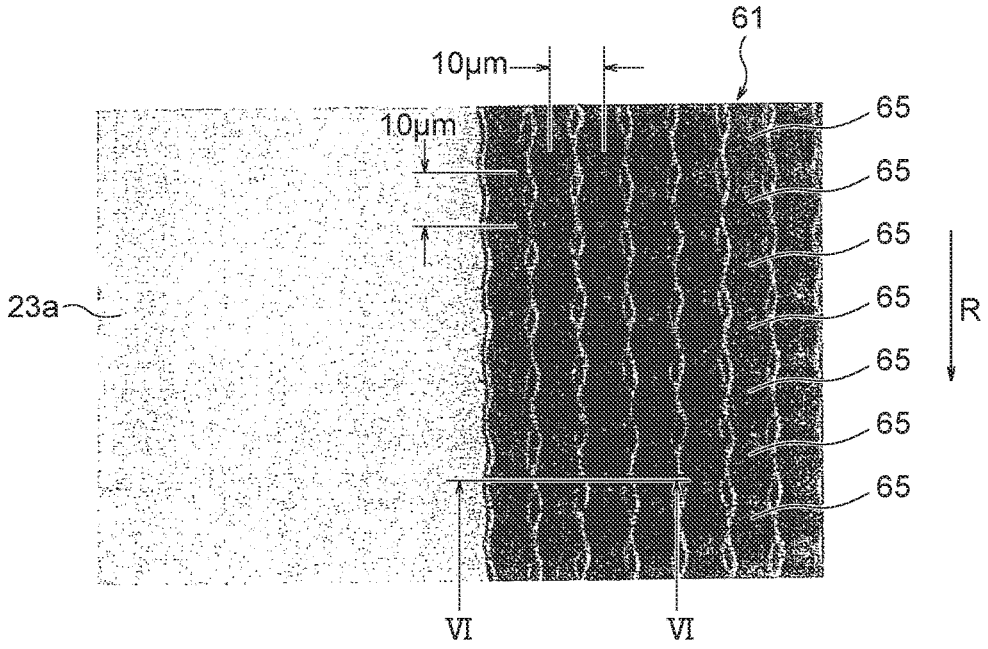
FIG. 5 is an enlarged view showing a part surrounded by a frame V shown by a chain line in FIG. 4 including a border between the portion where the position detection mark is formed and a portion where the position detection mark is not formed.
Figure 6:
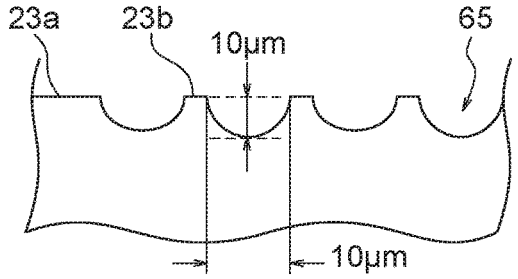
FIG. 6 is a sectional view taken along line VI-VI in FIG. 5.

Next, a forming method of the position detection mark 61 will be described. FIG. 5 is an enlarged view of a part surrounded by a frame V shown by a chain line in FIG. 4. FIG. 5 shows a border between a portion in which the position detection mark 61 is formed and a portion in which the position detection mark 61 is not formed on the outer surface 23*a* of the transfer belt 23. FIG. 6 is a sectional view taken along a line VI-VI shown in FIG. 5.

The position detection mark 61 is formed by modifying the outer surface 23*a* of the transfer belt 23 by irradiating the outer surface 23*a* with laser light using a laser marker "MD-V 9900A" manufactured by Keyence Corporation so that a visual reflectance of an irradiated portion becomes higher than a visual reflectance of the same portion before irradiation.

When the outer surface 23*a* of the transfer belt 23 formed of PAI is irradiated with laser light in a spot shape, grooves 65 (FIG. 5) are formed on the irradiated surface by heat. Each groove 65 is preferably formed along the rotating direction of the transfer belt 23 as shown by an arrow. In a particular example, as shown in FIG. 5, each groove 65 continuously extends in the rotating direction of the transfer belt 23, and a plurality of grooves 65 are arranged in the widthwise direction of the transfer belt 23.

The formation of the grooves 65 along the rotating direction of the transfer belt 23 allows for reduction of load generated when the blade 38 (FIG. 2) of the cleaning member 24 passes the position detection mark 61 by the rotation of the transfer belt 23. Therefore, chattering or turning-up of the blade 38 can be prevented. In a particular example, as shown in FIG. 5, a pitch of the grooves 65 in the widthwise direction of the transfer belt 23 is set to 10 μm. Further, a pitch of each groove 65 in the rotating direction of the transfer belt 23 is set to 10 μm.

In a particular example, the position detection mark 61 is formed by an uneven pattern in which the grooves 65 are densely disposed. The position detection mark 61 has a square shape (7 mm on each side) having rounded (arc-shaped) corners 61*a*. The provision of the rounded corners 61*a* is effective in reducing stress concentration. Therefore, wrinkling and bending of the transfer belt 23 can be prevented. In this regard, although the position detection mark 61 has a square shape (7 mm on each side), the shape and size of the position detection mark 61 is not limited as long as the position detection mark 61 can be detected by a sensor. For example, the position detection mark 61 may have a rectangular shape, a round shape or an elliptical shape. It is also possible that the position detection mark 61 does not have rounded corners.

In this regard, the term "uneven pattern" is used to mean a pattern (i.e., a concave/convex pattern) including at least one of concaves or convexes.

When the outer surface 23*a* of the transfer belt 23 is irradiated with laser light in a spot shape, the irradiated portion is modified so that the grooves 65 are formed by heat, and the irradiated portion is discolored into black. In a particular example, each groove 65 has a substantially hemispheric sectional shape as shown in FIG. 6. A boundary portion 23*b* is formed between adjacent grooves 65 on the outer surface 23*a* of the transfer belt 23. An inner diameter of the groove 65 is set to approximately 10 μm. A depth of a bottom of the groove 65 is also set to approximately 10 μm. The depth of the groove 65 can be adjusted by changing a wavelength, frequency, irradiation time or the like of the laser light for irradiation. The depth of the groove 65 will be described later.

In this regard, in order to increase a difference between a visual reflectance of the position detection mark 61 and a visual reflectance of a portion of the outer surface 23*a* of the transfer belt 23 where the position detection mark 61 is not formed, the grooves 65 are densely formed as shown in FIG. 5. However, the shapes, pitches and directions of the grooves 65 are not limited, but may be changed based on conditions such as material of the transfer belt 23 (i.e., the outer surface 23*a*) and a kind of the sensor for detecting the position detection mark 61, or the like.

Figure 7:
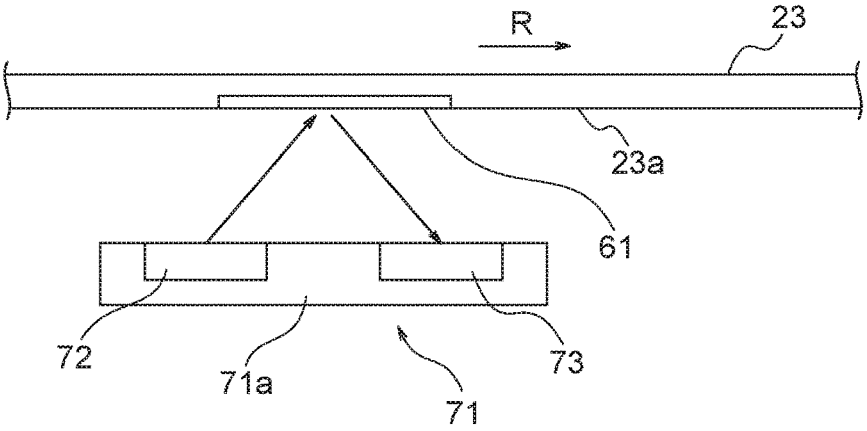
FIG. 7 is a schematic view showing a configuration of a reflection-type sensor as a detector for detecting the position detection mark formed on the transfer belt according to the first embodiment.

FIG. 7 is a schematic view showing a reflection-type sensor 71 as a detector (i.e., an optical sensor) for detecting the position detection mark 61 formed on the transfer belt 23.

The reflection-type sensor 71 detects the position detection mark 61 formed on the outer surface 23*a* of the transfer belt 23, and is disposed in the vicinity of the driving roller 20 in the image forming apparatus 1 as shown in FIG. 1.

As shown in FIG. 7, the reflection-type sensor 71 includes a light emitting portion 72 that emits light toward the transfer belt 23, a light receiving portion 73 that receives reflected light from the transfer belt 23, and a base 71*a* that holds the light emitting portion 72 and the light receiving portion 73 in a predetermined positional relationship. The reflection-type sensor 71 is disposed so that light emitted from the light emitting portion 72 is incident on a position on a travelling path of the position detection marks 61 of the rotating transfer belt 23, and reflected light is incident on the light receiving portion 73. The reflection-type sensor 71 outputs light-reception level information according to an intensity of the received light to a controller 100 of the image forming apparatus 1.

A visual reflectance of the position detection mark 61 is difference from a visual reflectance of a portion (i.e., a non-mark portion) on the outer surface 23*a* where the position detection mark 61 is not formed. Therefore, the light-reception level information sent to the controller 100 from the light receiving portion 73 receiving light from the non-mark portion is different from the light-reception level information sent to the controller 100 from the light receiving portion 73 receiving light from the position detection mark 61. Based on a difference in the light-reception level information, the controller 100 can detect the position detection mark 61.

The controller 100 controls the conveyance speed and position of the transfer belt 23 based on detection of the position detection mark 61 so that, for example, a detection timing of the position detection mark 61 corresponds to a predetermined timing. In this way, the conveyance of the transfer belt 23 can be controlled so as to keep constant a writing starting position while eliminating influence of an extension of the transfer belt 23.

Therefore, it is preferable that a difference between the visual reflectance of the position detection mark 61 and the visual reflectance of the non-mark portion of the outer surface 23*a* of the transfer belt 23 is large. Further, since the position detection mark 61 contacts the blade 38 (FIG. 2) of the cleaning member 24 provided for cleaning the transfer belt 23, it is preferable that the position detection mark 61 is less likely to wear and less likely to be smeared by toner adhesion even when the position detection mark 61 repeatedly contacts the blade 38. Further, it is preferable that a change in the visual reflectance from an initial visual reflectance is small even when the position detection mark 61 repeatedly contacts the blade 38.

Next, a modification of the embodiment will be described.

Figure 8:
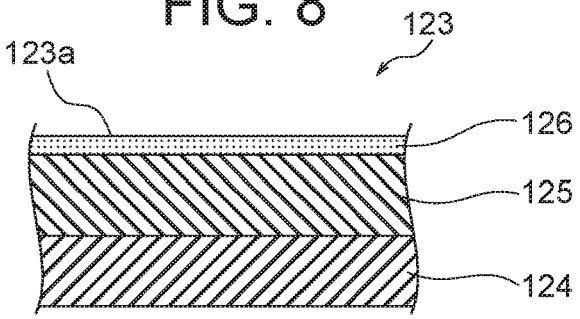
FIG. 8 is a sectional view showing a configuration of a transfer belt according to a modification.

FIG. 8 is a sectional view showing a configuration of a transfer belt (referred to as a transfer belt 123) according to a modification of the above described transfer belt 23. The transfer belt 123 includes three layers: a base layer 124 formed of resin, a resilient layer 125 formed on the base layer 124, and a surface layer 126 formed on the resilient layer 125. A position detection mark is formed by irradiating an outer surface 123*a* of the transfer belt 123 with laser light in a similar manner to the position detection mark 61 of the above described transfer belt 23 having the single-layer structure.

The base layer 124 is preferably composed of the same resin or same combination of resin as the above described transfer belt 23. The resilient layer 125 may be composed of urethane rubber, silicone rubber, NBR (nitrile butadiene rubber) or the like. The resilient layer 125 is preferably composed of urethane rubber in terms of strain characteristics. The surface layer 126 may be composed of fluorine-based resin, silicone-based resin, acryl-based resin, urethane-based resin or the like, but is not limited. The surface layer 126 is preferably composed of fluorine-based resin or urethane-based resin to which lubricating component is added for ensuring cleaning performance.

The lubricating component may be composed of fluorine-based resin, silicone-based resin, fluorine-based oil, silicone-based oil, fluorine-based particles, silicone-based particles or the like, alone or in combination. Further, the surface layer 126 may be added with conductive agent in order to ensure electric characteristics. The conductive agent may be, for example, various types of carbon black, ion conductive agent, metal oxide, conductive polymer or the like, but is not limited.

In a particular example, the resilient layer 125 composed of urethane rubber is formed on the base layer 124 composed of PVDF (Polyvinylidene Difluoride), and the surface layer 126 composed of urethane-based resin is formed on the resilient layer 125. Further, the surface layer 126 is added with conductive carbon black and PTFE (polytetrafluoroethylene) particles.

The transfer belt 123 of this modification is different from the transfer belt 23 shown in FIGS. 3 through 6 in that the transfer belt 123 has three layers while the transfer belt 23 has the single-layer structure. Further, an irradiated portion (i.e., a portion irradiated with laser light) of the outer surface 123*a* of the transfer belt 123 is different from the irradiated portion of the outer surface 23*a* of the transfer belt 23. A circumferential length and width of the transfer belt 123, a forming position of the position detection mark, and an irradiation position of laser light on the transfer belt 123 are the same as those of the transfer belt 23.

Figure 9:
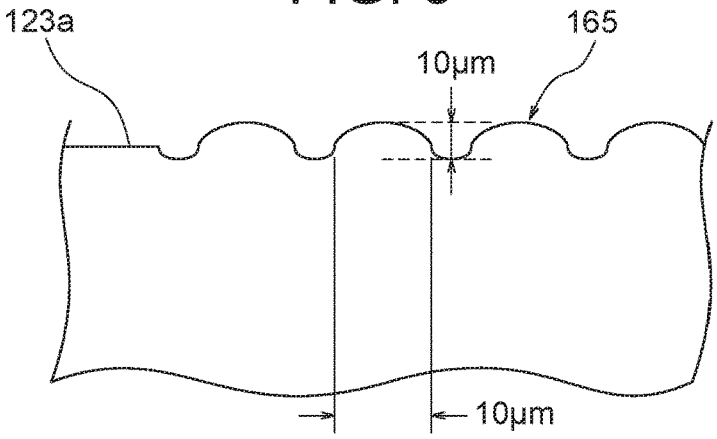
FIG. 9 is a sectional view showing a border between a portion where the position detection mark is formed and a portion where the position detection mark is not formed.

FIG. 9 is a sectional view showing a border between a portion where the position detection mark is formed on the outer surface 123*a* of the transfer belt 123 by irradiation of laser light and a portion where the position detection mark is not formed. FIG. 9 corresponds to the sectional view taken along line VI-VI shown in the above described FIG. 5. Irradiation with laser light is performed in a similar manner to that used to form the position detection mark 61 on the transfer belt 23 having the single-layer structure.

When the outer surface 123*a* of the transfer belt 123 is irradiated with laser light in a spot shape as shown in FIG. 9, the irradiated surface is modified by heat and protrudes to form convex portions 165. This is because the irradiated portion of the surface layer 126 foams by heat. Since the convex portions 165 are formed, a visual reflectance changes. Each convex portion 165 has a substantially semi-spherical shape. An outer diameter of the convex portion 165 is set to approximately 10 μm. A height of a top of the convex portion 165 is also set to approximately 10 μm. The protrusion of the convex portion 165 depends on the kind of resin or additives of the surface layer 126. When the surface layer 126 is formed of heat-sensitive material, the surface layer 126 irradiated with laser light is likely be deformed into a convex shape, and causes a large change in visual reflectance.

Therefore, the position detection mark on the transfer belt 123 of this modification is formed of an uneven pattern in which the convex portions 165 are densely formed.

Next, detection tests 1 through 3 of the position detection mark and evaluations thereof will be described. The detection tests 1 through 3 are performed using a plurality of sample belts whose position detection patterns have different shapes or whose position detection patterns are formed of different methods.

First, the detection test 1 of the position detection mark and evaluations thereof will be described.

The detection test 1 is performed under the following test conditions.

(1) The sample belts of Examples 1 and 2 and Comparison Examples 1, 2 and 3 are prepared.

The sample belt of Example 1 has a configuration of the transfer belt 23. The sample belt of Example 2 has a configuration of the transfer belt 123.

(2) The sample belt of Comparison Example 1 has a position detection mark (i.e., an uneven pattern) imparted by a mold in a molding process. Other features of the sample belt of Comparison Example 1 are the same as the transfer belt 23.

The sample belt of Comparison Example 2 has a position detection mark formed by grinding using a sandpaper. Other features of the sample belt of Comparison Example 2 are the same as the transfer belt 23.

The sample belt of Comparison Example 3 has a position detection mark formed by coating the same material as the sample belt itself on an outer surface thereof. Other features of the sample belt of Comparison Example 3 are the same as the above described transfer belt 23.

(3) A circumferential length L and a width W of each of the sample belts, and a position and a shape of the position detection mark of each of the sample belts are the same as those of the transfer belt 23.

(4) For each of the sample belts, a visual reflectance of the non-mark portion of the outer surface (where the position detection mark is not formed) is expressed as Yr, and a visual reflectance of the position detection mark is expressed as Yp. A difference ΔY is calculated according to the following equation:

$$\Delta Y = Yp - Yr.$$

As the difference ΔY is large, a contrast becomes higher, and a certainty with which the position detection mark is detected by the reflection-type sensor 71 increases.

(5) The visual reflectance is measured using a spectrometer "CM-2600d" manufactured by Konica Minolta Incorporated.

(6) Each sample belt is mounted to a color printer "C-910" manufactured by Oki Data Corporation. In this regard, the color printer "C-910" has a different configuration from the image forming apparatus 1 shown in FIG. 1. Printing is performed on 60,000 sheets of A4 size of landscape orientation using a pulverized toner whose mean particle diameter is 5.5 μm. After printing is completed, evaluation is performed on respective check items. When the position detection mark is detected without any problems, the evaluation result is rated as "○" (excellent). When misdetection occurs, the evaluation result is rated as "Δ". When the position detection mark is difficult to detect, the evaluation result is rated as "X" (poor).

FIG. 10 shows results of the detection test 1. The detection test 1 and evaluations thereof will be described with reference to FIG. 10.

As shown in FIG. 10, in each of Examples 1 and 2, the position detection mark is not smeared by toner, and excellent durability is obtained. Further, the difference ΔY is sufficiently high, and therefore the position detection mark can be stably detected.

In Comparison Example 1, a roughness on the surface of the sample belt is formed of the same resin as the sample belt itself. In Comparison Example 3, a coating on the surface of the sample belt is formed of the same resin as the sample belt itself. Therefore, in each of Comparison Examples 1 and 2, the difference ΔY is low, and therefore it is difficult to detect the position mark. Durability of the sample belt of Comparison Example 1 is excellent, but durability of the sample belt of Comparison Example 3 is poor. Further, the difference ΔY of the sample belt of Comparison Example 3 is smaller than the difference ΔY of the sample belt of Comparison Example 1.

In Comparison Example 2, fine convexes and concaves are formed in an entire area of the position detection mark. Therefore, the difference ΔY in the visual reflectance is large in an initial stage of printing. However, the difference ΔY decreases as the printing proceeds, since convexes and concaves are worn and become flat. Therefore, in Comparison Example 2, the position detection mark eventually becomes difficult to detect.

Next, the detection test 2 of the position detection mark and evaluations thereof will be described. In the detection test 2, the depth and density of the grooves of the position detection mark are varied from those of the transfer belt 23 of Example 1, and detection of the position detection mark is performed.

The detection test 2 is performed under the following test conditions.

(7) The sample belt of Example 1, and sample belts A, B, C and D are prepared.

The sample belt of Example 1 has the above described configuration of the transfer belt 23. The grooves 65 have a depth of 10 μm as shown in FIG. 6. Further, the grooves 65 are densely formed as shown in FIG. 5.

The sample belt "C" is obtained by changing the depth of the grooves of the sample belt of Example 1 to 13 μm.

The sample belt "D" is obtained by changing the depth of the grooves of the sample belt of Example 1 to 16 μm.

The sample belt "B" is obtained by reducing a density of formation of the grooves on the sample belt of Example 1 to an intermediate density level. To be more specific, the pitch of the grooves in the widthwise direction is changed to 20 μm.

The sample belt "A" is obtained by further reducing a density of formation of the grooves on the sample belt of Example 1 to a low density level. To be more specific, the pitch of the grooves in the widthwise direction is changed to 40 μm.

(8) Other test conditions are the same as the test conditions (3) through (6) described in the detection test 1.

FIG. 11 shows results of the detection test 2. The detection test 2 and evaluations thereof will be described with reference to FIG. 11.

As shown in FIG. 11, in each of the sample belts A and B and the sample belt of Example 1 having the grooves of 10 μm in depth, no toner strain is found on the position detection mark. In the sample belt A in which grooves are disposed at a low density, the difference ΔY is 0.7%, and therefore the position detection mark is difficult to detect. In the sample belt B in which grooves are disposed at an intermediate density, the difference ΔY is 1.6%, and therefore the position detection mark can be detected without any problems.

The sample belts C and D have the grooves which are disposed as densely as those of the sample belt of Example 1. In the sample belt C having the grooves of 13 μm in depth, the difference ΔY is 8%. In the sample belt D having the grooves of 16 μm in depth, the difference ΔY is 10%. The difference ΔY of each of the sample belts C and D is higher than the difference ΔY (3.8%) of the sample belt of Example 1.

However, in each of the sample belts C and D, when the printing on 60,000 sheets is completed, the position detection mark is smeared by toner, and the difference ΔY decreases. In the case of the sample belt C, the position detection mark can be detected without any problem in the initial stage of the printing, but cannot be accurately detected at a later stage. In the case of the sample belt D, the position detection mark can be detected without any problem in the initial stage of the printing, but become difficult to detect at a later stage.

From the results of the detection tests 1 and 2, it is understood that the difference ΔY in the visual reflectance is preferably larger than or equal to 1.6% in order that the position detection mark is detectable by the reflection-type sensor 71. Further, it is understood that the depth of the grooves of the position detection mark 61 is preferably less than or equal to 13 μm, and is more preferably less than or equal to 10 μm, in order to suppress the toner smear on the position detection mark. In this regard, the depth of the grooves correspond to the depth of the uneven pattern.

The toner smear will be further described. The toner smear appearing in an area of the position detection mark 61 (see FIG. 4) is caused by the toner embedded in the grooves and remaining therein without being scraped off by the cleaning member 24 (FIG. 1). The toner used in the detection tests has the mean particle diameter of 5.5 μm. From the results of the detection tests, it is understood that the toner smear can be prevented when the depth of the grooves is less than or equal to 1.8 times (10 μm) the mean particle diameter of the toner (5.5 μm).

In the detection test 2, the position detection marks of all the sample belts are formed of the uneven patterns (where the grooves are disposed) by irradiation of laser light as is the case with the transfer belt 23 of Example 1. Therefore, all the sample belts of the detection test 2 exhibit excellent durability.

Next, the detection test 3 of a position detection mark and evaluations thereof will be described. In the detection test 3, the depth of the grooves of the position detection mark is reduced with respect to the grooves of the transfer belt 23 of Example 1, and detection of the position detection mark is performed.

The detection test 3 is performed under the following test conditions.

(9) A sample belt F is obtained by forming grooves of the position detection mark 61 by irradiation with laser light (in a spot shape) of a reference irradiation amount. Sample belts E, G, H, I and J are obtained by varying the irradiation amount of laser light with respect to the reference irradiation amount. The sample belts E, F, G, H, I and J are the same as the sample belt of Example 1 except for the irradiation amount.

The sample belt E is obtained by forming grooves by increasing the irradiation amount by 20% with respect to the reference irradiation amount.

The sample belt G is obtained by forming grooves by decreasing the irradiation amount by 20% with respect to the reference irradiation amount.

The sample belt H is obtained by forming grooves by decreasing the irradiation amount by 40% with respect to the reference irradiation amount.

The sample belt I is obtained by forming grooves by decreasing the irradiation amount by 60% with respect to the reference irradiation amount.

The sample belt J is obtained by forming grooves by decreasing the irradiation amount by 80% with respect to the reference irradiation amount.

(10) Other test conditions are the same as the test conditions (3), (4) and (5) of the above described detection test 1.

In this regard, the position detection marks of all the sample belts are formed of the uneven patterns (where grooves are densely disposed) by irradiation of laser light (i.e., modifying) as it the case with the transfer belt 23 of Example 1. Further, the grooves of all the sample belts are sufficiently shallow. Therefore, all the sample belts exhibit excellent durability, and toner smear does not occur.

FIG. 12 shows results of the detection test 3. The detection test 3 and evaluations thereof will be described with reference to FIG. 12.

In the detection test 3, in each of the sample belts E through J, toner smear is not found, and the position detection mark can be detected without any problem. Further consideration will be described below.

In FIG. 12, a "depth of concave (μm)" indicates a depth of concave portions after irradiation of laser light with respect to the outer surface of the sample belt before irradiation. A "height of convex (μm)" indicates a height of convex portion (protrusion) formed around the concave portion with respect to the outer surface of the sample belt before irradiation. Here, a sum of the depth of the concave portions and the height of the convex portions is expressed as the depth of the grooves (i.e., the position detection mark). For each of the sample belts, the difference ΔY in the visual reflectance is obtained by subtracting the visual reflectance Yp of the position detection mark of the sample belt from the visual reflectance Yr (0.9) of the non-mark portion (where the position detection mark is not formed) of the outer surface of the sample belt as follows:

$$\Delta Y = Yp - Yr.$$

As can be understood from FIG. 3, the depth of the grooves and the difference ΔY in the visual reflectance vary depending on the irradiation amount of the laser light irradiated in a spot shape for forming the grooves. At least the difference ΔY in the visual reflectance has a lower limit higher than or equal to 1.0%. Depending on the irradiation amount of the laser light, there may be cases where the height of the convex portions (around the concave portions) is larger than the depth of the concave portions irradiated with laser light. The depth of the grooves influencing on the toner smear can be defined as a sum of the depth of the concave portions and the height of the convex portions. In this regard, the depth of the grooves corresponds to the depth of the uneven pattern.

In the detection test 3, a sample belt having the difference ΔY in the visual reflectance being less than or equal to 0.98% is not prepared. However, according to the detection test 2, the position detection mark is difficult to detect when the difference ΔY in the visual reflectance is 0.7%.

From the results of the detection tests 1 through 3, in order to ensure detection of the position detection mark (i.e., the uneven pattern) formed on the sample belt, the difference ΔY in the visual reflectance is preferably larger than or equal to 1.0% (i.e., a lower limit), and the depth of the grooves is preferably less than or equal to 2.3 times (13 μm) the mean particle diameter of the toner (5.5 μm), and is more preferably less than or equal to 1.8 times (10 μm) the mean particle diameter of the toner. In this regard, when the depth of the grooves is 2.3 times the mean particle diameter of the toner, the difference ΔY in the visual reflectance is 8%. When the depth of the grooves is 1.8 times the mean particle diameter of the toner, the difference ΔY in the visual reflectance is 3.8%.

In order to make the difference ΔY in the visual reflectance be larger than or equal to a predetermined value, it is preferable to modify the outer surface (i.e., a smooth surface) of the transfer belt 23 to form the uneven pattern on the position detection mark 61. In other words, it is preferable to reduce smoothness of the position detection mark 61. This is more effective in increasing the difference ΔY in the visual reflectance than finishing the position detection mark 61 smoother.

Further, the position detection mark may be formed of a plurality of convex portions 165 formed on the transfer belt 123 as described in the modification of the first embodiment. In this case, it becomes easier to increase the difference ΔY in the visual reflectance. Therefore, the position detection accuracy can be further enhanced. That is, conveyance and positioning of the transfer belt 123 can be accurately controlled during lifetime of the transfer belt 123.

As described above, according to the transfer belt 23 of the first embodiment, it becomes possible to obtain necessary durability of the position detection mark 61, and to obtain the difference ΔY in the visual reflectance required for detection of the position detection mark 61. Therefore, when the transfer belt 23 is used in the image forming apparatus 1, the position detection mark 61 can be prevented from being smeared with toner, and the difference ΔY in the visual reflectance can be suppressed from decreasing even when printing is performed on a large number of recording media. Accordingly, conveyance and positioning of the transfer belt 23 can be accurately controlled during lifetime of the transfer belt 23.

Second Embodiment

Figure 13:
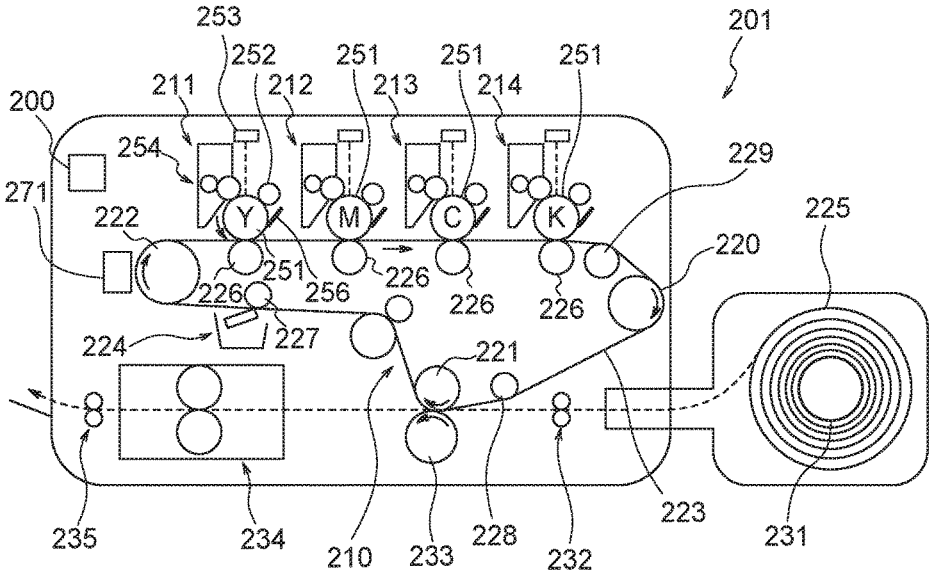
FIG. 13 is a schematic view showing a configuration of an image forming apparatus including a transfer belt according to the second embodiment of the present invention.

FIG. 13 is a schematic view showing a configuration of an image forming apparatus 201 including a transfer belt 223 according to the second embodiment of the present invention. The image forming apparatus 201 is configured as an electrophotographic color printer of an intermediate transfer type using a continuous sheet.

As shown in FIG. 13, the image forming apparatus 201 is provided with a medium holder 231 holding a recording medium 225 (for example, a continuous sheet) in the shape of a roller. The medium holder 231 is configured to rotatably hold the recording medium 225 by supporting, for example, a center core of the recording medium 225. When the recording medium 225 is pulled by conveying rollers 232 provided in the image forming apparatus 201, the medium holder 231 rotates following the recording medium 225 and continuously supplies the recording medium 225 to the image forming apparatus 201. The conveying rollers 232 convey the recording medium 225 to a secondary transfer portion.

The image forming apparatus 201 includes image forming units 211, 212, 213 and 214 configured to form toner images of yellow (Y), magenta (M), cyan (C) and black (K). The image forming units 211, 212, 213 and 214 are arranged along a moving direction of a transfer belt 223 (indicated by an arrow) from upstream to downstream so that respective photosensitive drums 251 of the image forming units 211, 212, 213 and 214 contact the transfer belt 223. The image forming units 211, 212, 213 and 214 have the same configuration except for toners to be used.

The image forming units 211, 212, 213 and 214 will be described with an example of the image forming unit 211 of yellow. Each of the image forming units 211, 212, 213 and 214 includes a photosensitive drum 251 (i.e., a latent image bearing body), a charging roller 252 (i.e., a charging member) that uniformly charges the surface of the photosensitive drum 251 by supplying electric charge thereto, an LED head 253 (i.e., an exposure unit) that emits light to expose the surface of the photosensitive drum 251 based on image data so as to form an electrostatic latent image, a developing unit 254 that develops the latent image on the surface of the photosensitive drum 251 with toner to form a toner image (i.e., a developer image), and a cleaning blade 256 disposed so as to contact the surface of the photosensitive drum 251 to remove a residual toner remaining thereon.

The image forming apparatus 201 further includes a transfer belt unit 210. The transfer belt unit 210 includes the transfer belt 223 as a belt having an endless shape (i.e., an endless belt), and a driving roller 222 driven to rotate by an actuator (not shown) and driving the transfer belt 223 in the direction shown by the arrow. The transfer belt unit 210 further includes supporting rollers 220 and 221. The transfer belt 223 is stretched around the supporting rollers 220 and 221 and the driving roller 222 in such a manner that a predetermined tension is applied to the transfer belt 223. The transfer belt unit 210 further includes primary transfer rollers 226 as primary transfer members disposed so as to face the photosensitive drums 251 via the transfer belt 223. The primary transfer rollers 226 are provided for primarily transferring toner images from the photosensitive drums 251 to the transfer belt 223. A movement of the transfer belt 223 around the driving roller 222 and the supporting rollers 220 and 221 as shown by the arrow may also be referred to as a "rotation" of the transfer belt 223.

A secondary transfer roller 233 as a secondary transfer member is provided so as to face the supporting roller 221 via the transfer belt 223. The secondary transfer roller 233 secondarily transfers the toner image (having been transferred to the transfer belt 223) to the recording medium 225. A cleaning member 224 is disposed so as to contact the transfer belt 223. The cleaning member 224 cleans the surface of the transfer belt 223 by removing a residual toner adhering to the transfer belt 223. The image forming apparatus 201 further includes a fixing device 234 configured to fix a toner image to the recording medium 225 by application of heat and pressure, and conveying rollers 235 configured to eject the recording medium 225 with the fixed toner image to outside the image forming apparatus 201. The secondary transfer roller 233 and the supporting roller 221 form a secondary transfer portion.

A printing operation (i.e., image formation) of the image forming apparatus 201 having the above described configuration will be described. In this regard, an arrow shown by a dashed line in FIG. 13 indicates a conveying direction of the recording medium 225.

In each image forming units 211, 212, 213 and 214, the surface of the photosensitive drum 251 is uniformly charged by the charging roller 252 applied with a charging voltage by a power source (not shown). Then, when a charged part of the surface of the photosensitive drum 251 reaches a position facing the LED head 253 by the rotation of the photosensitive drum 251 (as shown by an arrow), the LED head 253 emits light to expose the surface of the photosensitive drum 251 so as to form an electrostatic latent image. The latent image is developed by the developing unit 254, and a toner image is formed on the surface of the photosensitive drum 251.

When the toner image on the photosensitive drum 251 passes through a primary transfer position where the photosensitive drum 251 contacts the transfer belt 223, the toner image is primarily transferred to the transfer belt 223 by the primary transfer roller 226 applied with a primary transfer voltage by a power source (not shown). Timings at which the toner images are formed on the photosensitive drums 251 are controlled so that toner images of respective colors are transferred to the transfer belt 223 in an overlapping manner. A color image is formed by toner images of yellow, magenta, cyan and black formed on the transfer belt 223.

In parallel with transfer of the color image to the transfer belt 223, the recording medium 225 set in the medium holder 231 is fed out therefrom by the conveying rollers 232 to reach a contact portion between the secondary transfer roller 233 and the transfer belt 223, i.e., a secondary transfer position. When the recording medium 225 passes through the secondary transfer position, the toner image (i.e., color image) on the transfer belt 223 is transferred to a predetermined position on the recording medium 225 by the secondary transfer roller 233 applied with a secondary transfer voltage by a power source.

Then, the recording medium 225 with the transferred toner image (i.e., the color image) is conveyed to the fixing device 234. The toner is molten and is fixed to the recording medium 225 by being heated and pressed by the fixing device 234. Then, the recording medium 225 with the fixed toner image is conveyed by the conveying roller 235 to a stacker portion (not shown) disposed outside the image forming apparatus 201. After the recording medium 225 separates from the transfer belt 223, the cleaning member 224 cleans the transfer belt 223 by removing the toner and other contamination from the transfer belt 223.

Figure 14:
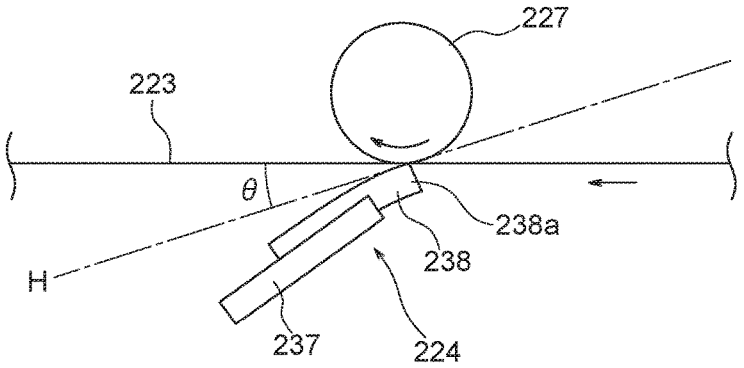
FIG. 14 is an enlarged view showing a configuration of a cleaning member shown in FIG. 13 together with a guide roller facing the cleaning member.

FIG. 14 is an enlarged view showing a configuration of the cleaning member 224 shown in FIG. 13 together with a guide roller 227 facing the cleaning member 224.

As shown in FIG. 14, the cleaning member 224 includes a blade 238 and a supporting member 237 that holds the blade 238. The blade 238 is fixed by the supporting member 237 with respect to a main body of the image forming apparatus 201 so that the blade 238 is pressed against the guide roller 227 via the transfer belt 223. The blade 238 is preferably composed of a resilient material having a rubber hardness (JIS-A hardness) in a range from 65 to 100 degrees. In a particular example, the blade 238 is composed of urethane rubber having a thickness of 2.0 mm, and a JIS-A hardness of 78 degrees. This is because the blade 238 formed of a resilient body such as urethane rubber exhibits excellent performance in cleaning the residual toner and contaminations on the transfer belt 223, can be simple and compact in structure, and can be manufactured at low cost. In this regard, the blade 238 is held so that the blade 238 extends toward the guide roller 227 from downstream in a rotating direction of the transfer belt 23.

Further, in a particular example, the blade 238 is held by the supporting member 237 so that a contact angle θ is 21 degrees, and a linear pressure is 4.3 g/mm. The linear pressure is preferably in a range from 1 to 6 g/mm, and more preferably in range from 2 to 5 g/mm. This is because of the following reason. When the linear pressure is too low, a force with which the blade 238 is pressed against the transfer belt 223 becomes insufficient and may cause cleaning failure. When the linear pressure is too high, surfaces of the blade 238 and the transfer belt 223 contact each other, and frictional resistance may increase. In such a case, a force with which the blade 238 is pressed against the transfer belt 223 may exceed a force with which the blade 238 scrapes off the toner from the transfer belt 223, and a turning-up of the blade 238 may occur.

The contact angle θ is preferably in a range from 20 to degrees, and more preferably in a range from 20 to 25 degrees. In this regard, the contact angle θ is an angle between an end portion 238*a* of the cleaning blade 238 and a tangential line at a contact portion where the end portion 238*a* contacts the surface of the transfer belt 223.

The transfer belt 223 of the second embodiment has a single-layer structure, and is composed of polyamide imide (PAI). In this regard, the transfer belt 223 is not limited to PAI. It is preferable that a deformation of the transfer belt 223 under tension is in a predetermined range in terms of durability and mechanical strength. For example, the transfer belt 223 may be composed of material having a Young' modulus higher than or equal to 2000 MPa (more preferably, 3000 MPa) such as PAI, polyimide (PI), polyether imide (PEI), polyphenylene sulphide (PPS), polyetheretherketone (PEEK), polyvinylidene fluoride (PVDF), polyamide (PA), polycarbonate (PC), and polybutylene terephthalate (PBT), alone or in combination.

Further, the resin is added with conductive material. The conductive material may be conductive carbon, ion conductive agent, conductive polymer or the like. Particularly, carbon black is suitable. Carbon black may be, for example, furnace carbon black, channel carbon black, acetylene carbon black or the like, but not limited to these material.

These kinds of carbon black may be used alone or in combination, and may be appropriately selected according to desired conductivity (i.e., electrical conductivity). For the transfer belt 223 of the image forming apparatus 201, it is preferable to use channel carbon black and furnace carbon black in order to obtain a predetermined resistance. Carbon black is preferably subjected to oxidation treatment or craft treatment for preventing oxidative degradation, and preferably subjected to treatment for enhancing dispersibility into a solvent.

In the transfer belt 223 of the image forming apparatus 201, content of carbon black is preferable in a range from 3 to 40 weight % (more preferably in a range from 3 to 30 weight %) with respect to a resin solid content for obtaining mechanical strength or the like. As well as an electron conductivity imparting method using carbon black or the like, it is also possible to use ion conductivity imparting method using ion conductive agent.

Figure 15:
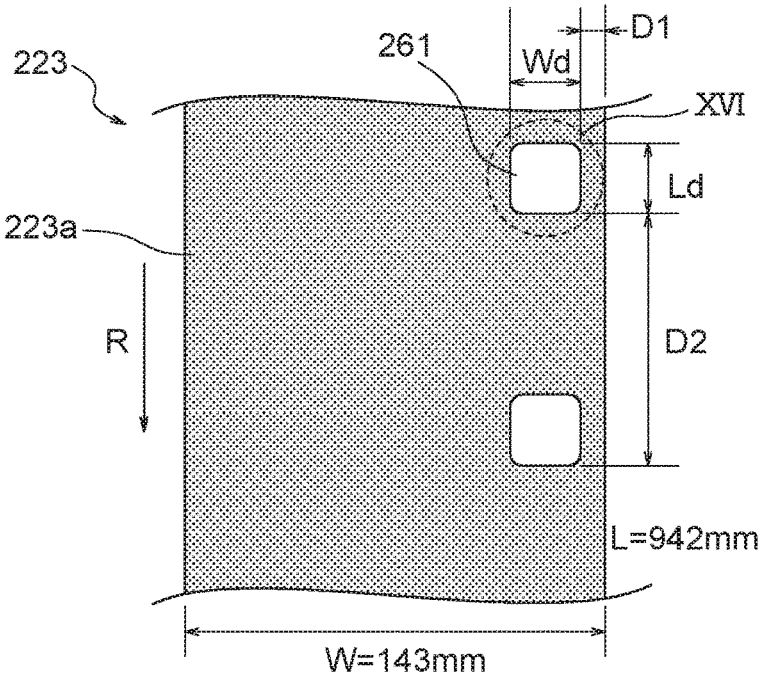
FIG. 15 is a plan view showing a part of the transfer belt according to the second embodiment, in which an arrow shows a rotating direction of the transfer belt.

A configuration of the transfer belt 223 will be described. FIG. 15 is a plan view showing a part of the transfer belt 223 having an endless shape. In FIG. 15, an arrow R shows a rotating direction of movement of the transfer belt 223.

Figure 16:
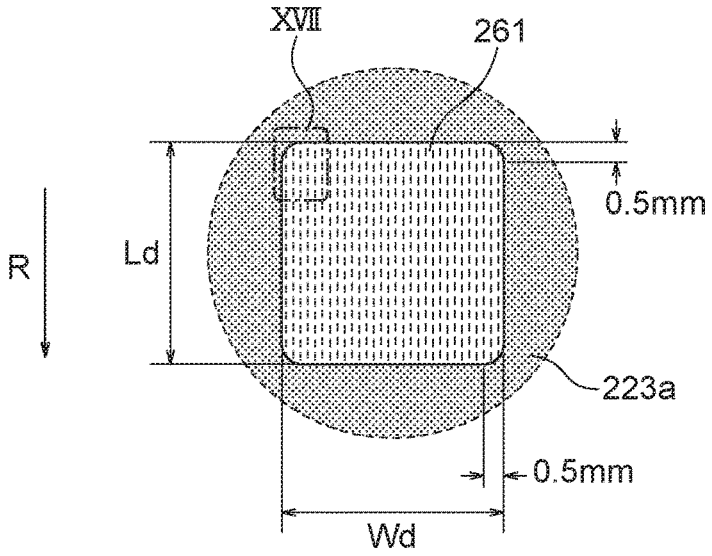
FIG. 16 is an enlarged view of a part surrounded by a circle XVI shown by a chain line in FIG. 15 including a portion where the position detection mark is formed.
Figure 17:
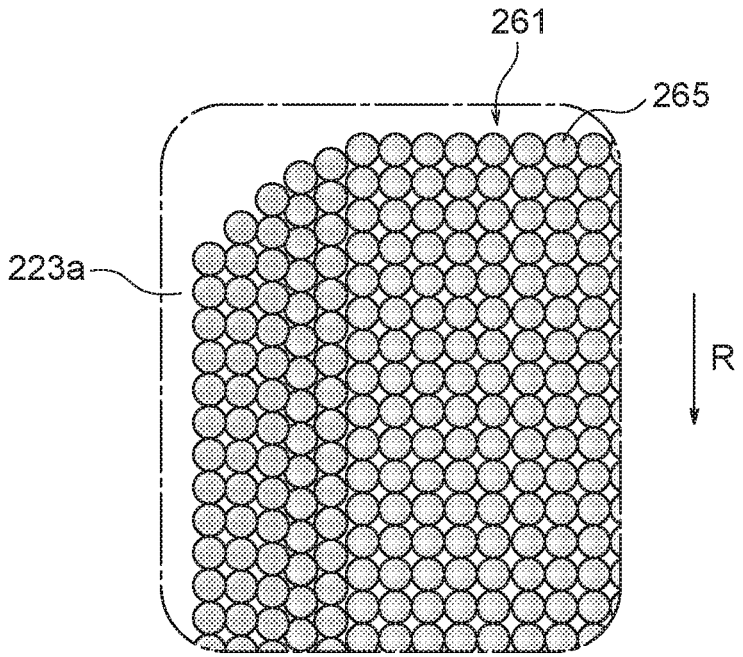
FIG. 17 is an enlarged view of a part surrounded by a frame XVII shown by a chain line in FIG. 16.
Figure 18:
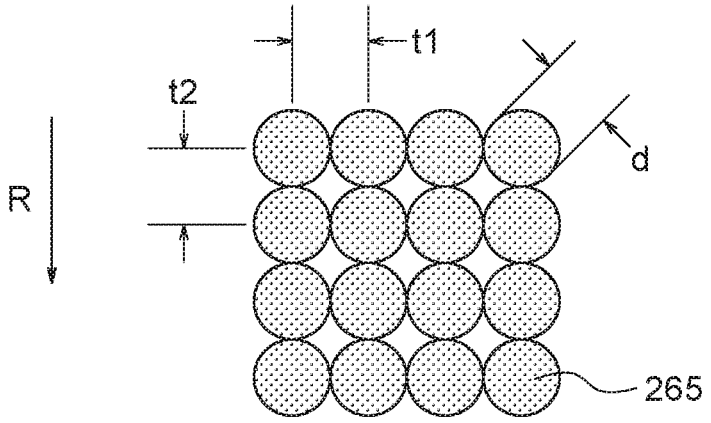
FIG. 18 is an enlarged view of a part of the position detection mark shown in FIG. 17.

For example, the transfer belt 223 has a width W of 143 mm, a circumferential length L of 942 mm, and a thickness of 80 μm. FIG. 16 is an enlarged view of showing a part indicated by a circle XVI shown by a chain line in FIG. 15 where a position detection mark 261 is formed. FIG. 17 is an enlarged view of a part indicated by a frame XVII shown by a chain line in FIG. 16. FIG. 18 is an enlarged view of a part of the position detection mark 261 shown in FIG. 17.

As shown in FIG. 15, the position detection marks 261 are formed on an outer surface 223*a* of the transfer belt 223, and are disposed at an end portion of the transfer belt 223 in a widthwise direction of the transfer belt 223. The position detection mark 261 is formed by modifying the outer surface 223*a* of the transfer belt 223 by irradiating the outer surface 223*a* with laser light using a laser marker "MD-V 9900A" manufactured by Keyence Corporation to thereby form uneven points 265 (i.e., concave/convex points) in the form of spots which are arranged as shown in FIG. 17. A width Wd of the position detection mark 261 in the widthwise direction of the transfer belt 223 and a length Ld of the position detection mark 261 in a circumferential direction (i.e., the rotating direction) of the transfer belt 223 will be described later.

When the outer surface 223*a* of the transfer belt 223 formed of PAI is irradiated with laser light, the irradiated surface is modified, and the uneven points 265 are formed. Each uneven point 265 has a spot diameter of approximately 0.1 mm, and includes a concave portion in the form of a spot, and a convex portion formed by thermal expansion in the vicinity of (more specifically, on a periphery of) the concave portion. A height difference of the uneven point 265 can be increased by increasing an intensity of the laser light, and can be reduced by reducing the intensity of the laser light.

Here, the "height difference" indicates a depth of the uneven point 265, and corresponds to a distance between a top of the convex portion to a bottom of the concave portion. A spot diameter d of the uneven point 265 is 0.1 mm. A pitch (i.e., a center-to-center distance) t1 of the uneven points 265 in the widthwise direction is 0.08 mm. A pitch t2 of the uneven points 265 in the circumferential direction is 0.1 mm.

The uneven points 265 are preferably arranged along the rotating direction of the transfer belt 223. In a particular example, a plurality of rows are arranged in the widthwise direction of the transfer belt 223, and each row including a plurality of uneven points 265 arranged in the rotating direction of the transfer belt 223.

Formation of the uneven points 265 along the rotating direction of the transfer belt 223 allows for reduction of load generated when the blade 238 (FIG. 13) of the cleaning member 224 passes the position detection mark 261 by the rotation of the transfer belt 223. Therefore, chattering or turning-up of the blade 238 can be prevented.

In a particular example, the position detection mark 261 has a square shape having rounded (arc-shaped) corners, and each rounded corner has a radius of 0.5 mm. Provision of the rounded corners is effective in reducing stress concentration. Therefore, the transfer belt 223 can be prevented from being damaged in an early stage of lifetime. Further, the blade 238 (FIG. 13) can be prevented from being damaged by chipping or turning-up of a border between the position detection mark 261 and a non-mark portion.

Figure 19:
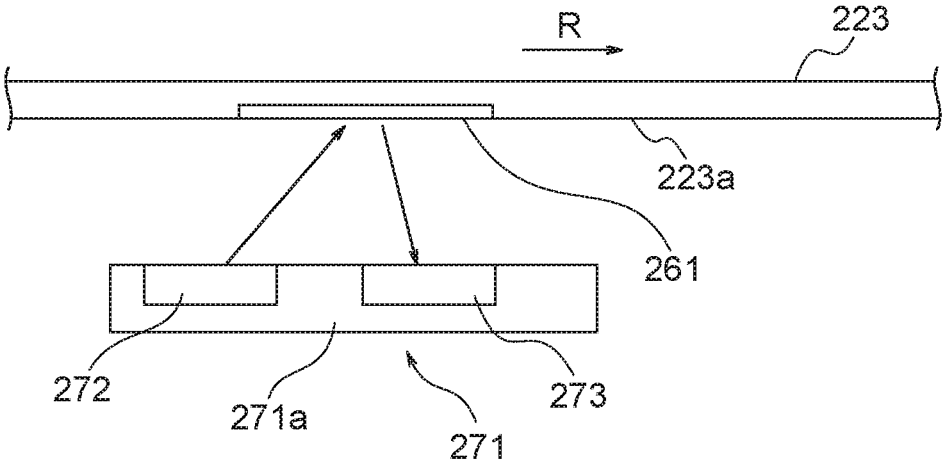
FIG. 19 is a schematic view showing a configuration of a reflection-type sensor as a detector for detecting the position detection mark formed on the transfer belt according to the second embodiment.

FIG. 19 is a schematic view showing a reflection-type sensor 271 as a detector (i.e., an optical sensor) for detecting the position detection mark 261 formed on the transfer belt 223.

As shown in FIG. 19, the reflection-type sensor 271 includes a light emitting portion 272 that emits light toward the transfer belt 223, a light receiving portion 273 that receives reflected light from the transfer belt 223, and a base 271*a* that holds the light emitting portion 272 and the light receiving portion 273 in a predetermined positional relationship. The reflection-type sensor 271 is disposed so that light emitted from light emitting portion 272 is incident on a position on a travelling path of the position detection marks 261 of the rotating transfer belt 223, and the reflected light is incident on the light receiving portion 273. The reflection-type sensor 271 outputs light-reception level information according to an intensity of the received light to a controller 200 of the image forming apparatus 201. In a particular example, the light receiving portion 273 includes a light receiving element having a spot diameter (referred to as a light reception spot diameter) α of 2 mm.

The position detection mark 261 has a height difference which is different from that of the non-mark portion on the outer surface 223*a* where the position detection mark 261 is not formed. Therefore, the light-reception level information sent to the controller 200 from the light receiving portion 273 receiving light from the non-mark portion is different from the light-reception level information sent to the controller 200 from the light receiving portion 273 receiving light from the position detection mark 261. Based on the difference of the light-reception level information, the controller 200 can detect the position detection mark 261.

The controller 200 controls the conveyance speed and position of the transfer belt 223 based on detection of the position detection mark 261 so that, for example, a detection timing of the position detection mark 261 corresponds to a predetermined timing. In this way, the conveyance of the transfer belt 223 can be controlled so as to keep constant a writing starting position while eliminating influence of an extension of the transfer belt 223.

Therefore, it is preferable that the height difference of the uneven points 265 of the position detection mark 261 is larger than the height difference of the non-mark portion of the outer surface 223*a*. Further, since the position detection mark 261 contacts the blade 238 (FIG. 14) of the cleaning member 224 provided for cleaning the transfer belt 223, it is preferable that the position detection mark 261 is less likely to wear and less likely to be smeared by toner adhesion even when the position detection mark 261 repeatedly contacts the blade 238. Further, it is preferable that a change in the height difference of the uneven points 265 from an initial height difference is small even when the position detection mark 261 repeatedly contacts the blade 238.

Although the number of the position detection mark(s) 261 may be 1, it is preferable to provide a plurality of position detection marks 261 at equal intervals (or equal pitches) along the rotating direction of the transfer belt 223. An extension and a speed variation of the transfer belt 223 can be calculated based on a distance between adjacent position detection marks 261. Therefore, it is preferable that the interval between the position detection marks 261 is short, so that a color shift and a writing starting position can be controlled accurately.

In the second embodiment, a pitch D2 (FIG. 25) of the position detection marks 261 is set to 78 mm which is the same as a pitch of the photosensitive drums 251 (FIG. 13). In this regard, the pitch of the photosensitive drums 251 is set to be the same as a circumferential length of the driving roller 222. This setting is effective in reducing a color shift resulting from a variation in thickness of the transfer belt 223.

When a variation in thickness of the transfer belt 223 is large, a moving speed of the outer surface 223*a* of the transfer belt 223 partially changes according to the variation in thickness. At a portion where the transfer belt 223 is thick, the moving speed of the outer surface 223*a* of the transfer belt 223 becomes faster. At a portion where the transfer belt 223 is thin, the moving speed of the outer surface 223*a* of the transfer belt 223 becomes slower.

In order to reduce the color shift resulting from the variation in thickness of the transfer belt 223 (i.e., a film thickness), it is the best way to minimize variation in thickness of the transfer belt 223. However, when the transfer belt 223 is formed of resilient material and is relatively thick, it is difficult to minimize the variation in thickness. With a configuration in which a cycle of the variation in thickness of the transfer belt 223 is synchronized with movement of the transfer belt 223 between the adjacent photosensitive drums 251 (FIG. 13), the color shift cyclically caused by the variation in thickness of the transfer belt 223 can be reduced, and accuracy in controlling the conveying speed of the transfer belt 223 can be enhanced. Further, since the pitch of the position detection marks 261 is the same as the pitch of the photosensitive drums 251 (FIG. 13), accuracy in feedback control of the conveying speed of the transfer belt 223 can be enhanced.

Here, detection tests 4 through 7 of the position detection mark and evaluations thereof will be described. The detection tests 4 through 7 are performed using a plurality of sample belts whose position detection patterns have different shapes. Features of the sample belts are the same as the above described features of the transfer belt 223 except for the shape of the position detection patterns.

The image forming apparatus 201 shown in FIG. 13 is used as a test apparatus in the detection tests. A light emission current applied to the light emitting portion 272 of the reflection-type sensor 271 is adjusted so that the light receiving portion 273 outputs a light reception voltage of 2.7 V when receiving light reflected by the non-mark portion of the transfer belt 223. The sample belt is mounted to the test apparatus in replacement of the transfer belt 223. While the sample belt is rotated at a speed of 6 ips (inch per second), the light reception voltage outputted by the light receiving portion 273 receiving light reflected by the position detection mark of the sample belt is detected.

A light reception voltage difference ΔV1 of a non-mark portion and the position detection mark part is calculated by subtracting the light reception voltage of the non-mark portion from the light reception voltage of the position detection mark.

In order to stably detecting the position detection mark to control the conveyance of the transfer belt 223, it is preferable that the light reception voltage difference ΔV1 is large. For example, the light reception voltage difference ΔV1 is preferably larger than or equal to 1.0 V. When the light reception voltage difference ΔV1 is in this range, detection of the position detection mark is not influenced by an individual difference or a positioning variation of the reflection-type sensor 271, or a noise generated by scratches on the non-mark portion of the outer surface of the transfer belt 223 (that may increase as a printing amount increases).

First, the detection test 4 and evaluations thereof will be described. In the detection test 4, a plurality of sample belts having the uneven points 265 (FIG. 17) with different height differences are prepared.

The detection test 4 is performed by the following test conditions.

(1) The position detection mark (FIG. 15) of each sample belt used in this test has the width Wd of 7 mm in the widthwise direction of the sample belt, and the length Ld of 7 mm in the circumferential direction of the sample belt.

(2) The position detection marks having the uneven points 265 with different height differences (i.e., different depths) are formed by adjusting intensities of laser light used for irradiation. The height difference of the position detection mark is determined by measuring a maximum height of the convex portion and a maximum depth of the concave portion using a laser microscope "VK8500" manufactured by Keyence Corporation, and calculating a difference between the maximum height and the maximum depth.

(3) In Examples 11-15 and Comparison Examples 11-13, a contour (i.e., an outer edge) of the position detection mark is irradiated twice with laser light in order to emphasize the contour of the position detection mark. In Example 16, the contour of the position detection mark is irradiated once as is the case with other parts of the position detection mark.

Figure 20A:
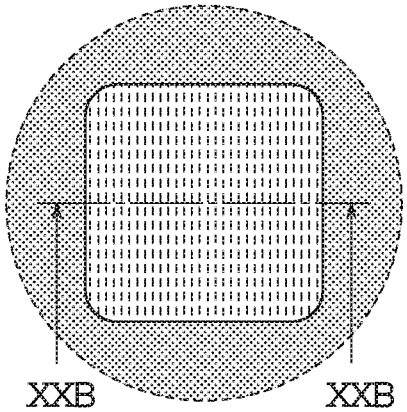
FIG. 20A is a plan view showing the position detection mark having a rectangular shape formed on a sample belt according to the second embodiment.
Figure 20B:
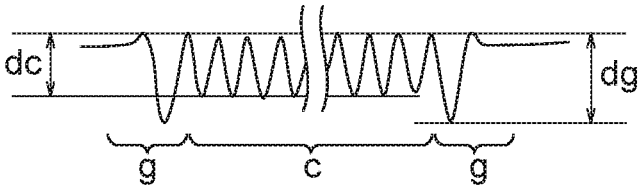
FIG. 20B is a sectional view taken along line XXB-XXB in FIG. 20A.

FIG. 20A is a plan view showing a shape of the position detection mark formed on the sample belt and having a substantially rectangular shape. FIG. 20B is a sectional view taken along line XXB-XXB in FIG. 20A. As shown in FIG. 20B, the height difference (depth) of the uneven point 265 at a contour of the position detection mark (i.e., a mark contour portion g) is expressed as dg (μm), a height difference of the uneven point 265 at a center of the position detection mark (i.e., a mark center portion c) is expressed as dc (μm).

(4) Each sample belt is mounted to the test apparatus, and printing is performed using a pulverized toner having a mean particle diameter of 5.5 μm. After printing is completed, evaluation is performed on respective check items.

(5) A linear speed of a rotation of the sample belt during printing is set to 6 ips (an inch/s).

(6) Results of the detection test 4 are evaluated as follows.

When the difference ΔV1 is larger than or equal to 1.0V (i.e., detection is performed without any problem), the evaluation result is rated as "O" (excellent).

When the difference ΔV1 is less than 1.0V (i.e., when the difference in the light reception voltage is small), the evaluation result is rated as "Δ".

When detection is performed without any problem (i.e., ΔV1≥1.0V) but toner smear (that cannot be removed by the cleaning blade during one rotation of the sample belt) occurs, the evaluation result is rated as "▲".

When detection is performed without any problem (i.e., ΔV1≥1.0V), but a detected waveform includes no peak as a starting point (described later) of the position detection mark, the evaluation result is rated as "□".

FIG. 21 shows results of the detection test 4. The detection test 4 and evaluations thereof will be described with reference to FIG. 21.

As shown in FIG. 21, the difference ΔV1 in the light reception voltage between the position detection mark and the non-mark portion depends on the height difference of the position detection mark. As the height difference of the position detection mark is larger, the difference ΔV1 in the light reception voltage becomes larger.

It is understood that, when the height difference at the mark center portion dc is larger than or equal to 2.0 μm (dc≥2.0 μm), the difference ΔV1 in the light reception voltage is larger than or equal to 1.0V (ΔV1≥1.0V), and therefore the position detection mark is detectable. This is because an amount of specular reflection at the position detection mark is smaller than the non-mark portion (i.e., a smooth surface) since the position detection mark includes uneven points. In contrast, when the height difference is small as in Comparison Examples 12 and 13, the difference ΔV1 in the light reception voltage is small, which is not preferable.

Further, when the height difference is larger than necessary as in Comparison Example 11, the difference ΔV1 in the light reception voltage is larger than or equal to 1.0 V (ΔV1≥1.0V), and therefore the position detection mark is detectable. However, in this case, cleaning failure of toner is found. This is because, when the height difference of the position detection mark is larger than the mean particle diameter of toner, toner particles may be buried in the concave portions of the position detection mark and cannot be scraped off by the cleaning blade by one passage of the position detection mark through the cleaning blade.

Figure 22A:
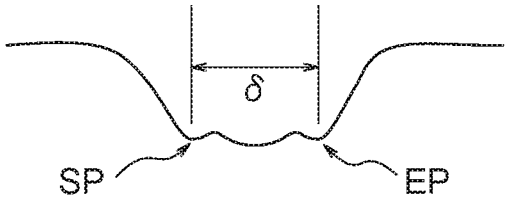
FIG. 22A is a schematic view showing a waveform detected when an outer edge portion of the position detection mark is irradiated with laser twice according to the second embodiment.
Figure 22B:
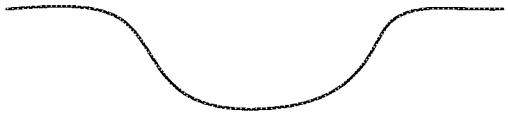
FIG. 22B is a schematic view showing a waveform detected when an outer edge portion of the position detection mark is not irradiated with laser twice according to the second embodiment.

FIGS. 22A and 22B are schematic views showing detected waveforms of the light reception voltage. FIG. 22A shows a case when the outer edge portion of the position detection mark is irradiated with laser light twice. FIG. 22B shows a case when the outer edge portion of the position detection mark is irradiated with laser light once.

In each of Examples 11 through 15, the mark contour portion is irradiated with laser twice so as to form the position detection mark satisfying the relationship: dg>dc. Therefore, as schematically shown in FIG. 22A, a peak is formed at a starting point (indicated by mark "SP") of the detected waveform of the position detection mark. Using the peak of the detected waveform, the starting point SP of the position detection mark can be detected, therefore accuracy in detecting the position detection mark is enhanced.

In contrast, when the mark contour portion is irradiated with laser once as is the case with other parts of the position detection mark, the detected waveform of the position detection mark is as shown in FIG. 22B. In this case, no peak is found in the detected waveform. Therefore, detection of the position detection mark becomes harder as compared with the case where the mark contour portion is irradiated twice, and therefore accuracy in detecting the position detection mark decreases.

From these results, it is understood that the height difference dg of the mark contour portion is preferably larger than the height difference dc of the mark center portion (i.e., dg>dc), and the height difference dc of the mark center portion is preferably larger than or equal to 2.0 μm (i.e., dc≥2.0 μm), in order that the position detection mark including the uneven points 265 in the form of spots is detectable.

Further, as shown in FIG. 21, each of the position detection marks which are excellent in detection is formed of the uneven points having height differences in a range from 2 μm to 10.2 μm.

Next, the detection test 5 and evaluations thereof will be described. In the detection test 5, a plurality of sample belts with position detection marks having different lengths Ld (FIG. 15) are prepared.

The detection test 5 is performed under the following test conditions:

(7) Each of the position detection marks (FIG. 15) of the sample belts of Examples 17 through 26 and Comparison Examples 14 and 15 has the height difference dg of approximately 5.5 μm at the mark contour portion and the height difference dc of approximately 3.2 μm at the mark center portion. The position detection mark is formed by irradiation with laser light under the same conditions as the position detection mark of the sample belt of Example 13.

The position detection marks of the sample belts of Examples 17 through 26 and Comparison Examples 14 and 15 have the same width Wd of 7 mm, but have the different lengths Ld in a range from 1 to 20 mm.

(8) A detection length δ of the detected position detection mark in the circumferential direction corresponds to a length from the starting point SP to an end point EP of the detected waveform (FIG. 22A) of the position detection mark. The detection length δ does not include inclined step portions, and therefore is slightly different from the length Ld.

(9) The sample belt is left under a temperature of 28° C. and a relative humidity of 80% for two weeks. This is referred to as a long time leaving.

(10) Results of the detection test 5 are evaluated as follows.

When the difference ΔV1 is larger than or equal to 1.0V (i.e., detection is performed without any problem), and when the detection length δ is sufficiently long, the evaluation result is rated as "○" (excellent).

When the detection length δ is short and resembles a scratch on the outer surface of the sample belt (that may be caused by being used for a long time), the evaluation result is rated as "Δ".

When the detection length δ is substantially the same as a detection width of a roller mark (i.e., a contact trace) that may be formed on the sample belt by the long time leaving, the evaluation result is rated as "▲".

When the difference ΔV1 is less than 1.0V, and when the detection length δ is short and resembles a scratch on the outer surface of the sample belt (that may be caused by being used for a long time), the evaluation result is rated as "X" (poor).

When detection is performed without any problem (i.e., ΔV1≥1.0V) but a waving is found at the position detection mark, the evaluation result is rated as "□".

Other test conditions of the detection test 5 are the same as the detection test 4.

FIG. 23 shows results of the detection test 5. The detection test 5 and evaluations thereof will be described with reference to FIG. 23.

As shown in FIG. 23, when the length Ld of the position detection mark is longer than or equal to 2 mm, the difference ΔV1 is larger than 1.0 V, and the position detection mark is detectable. In contrast, when the length Ld of the position detection mark is 1 mm, the difference ΔV1 is larger than 0.7 V, and the difference in the light reception voltage is insufficient. This is because of the following reason. The light reception spot diameter α of the light receiving spot of the light receiving portion 273 (FIG. 19) of the reflection-type sensor 271 is 2 mm. When the length Ld of the position detection mark in the circumferential direction is smaller than the light reception spot diameter α, the light receiving portion 273 receiving reflected light from the position detection mark may also receive reflected light from the non-mark portion, and therefore the difference ΔV1 in the light reception voltage decreases.

In contrast, when the length Ld of the position detection mark in the circumferential direction is larger than or equal to the light reception spot diameter α, the light receiving portion 273 receiving reflected light from the position detection mark hardly receives reflected light from the non-mark portion. Therefore, the sufficient difference ΔV1 in the light reception voltage can be obtained.

However, when the length Ld of the position detection mark in the circumferential direction is 2 mm, the detection length δ is short. Further, the position detection mark resembles a scratch on the outer surface of the sample belt that may be caused by being used for a long time. When the length Ld is 3 mm, 4 mm and 20 mm, the detection length δ is respectively 2.2 mm, 3.2 mm and 15.7 mm, and becomes substantially the same as a detection width of a contact trace (caused by contact between the transfer belt and a roller).

That is, when the detection length δ is 2.2 mm or 3.2 mm, the detection length δ becomes substantially the same as the detection width of the contact trace caused by contact between the transfer belt and the support roller 228 or 229 (FIG. 13). When the detection length δ is 15.7 mm, the detection length δ becomes substantially the same as the detection width of the contact trace caused by contact between the transfer belt and the driving roller 222 (FIG. 13).

Further, when the length Ld is longer than or equal to 20 mm, the outer surface of the sample belt is largely modified, and a portion (to be more specific, an end portion in the widthwise direction) of the sample belt where the position detection mark is formed may be deformed. As a result, waving of the sample belt occurs. The waving of the sample belt may cause the sample belt to run on a flange (not shown) as a meandering preventing member, which may result in reducing durability and shortening lifetime.

For these reasons, it is necessary that the length Ld of the position detection mark is larger than or equal to the light reception spot diameter α of the light receiving portion 273 of the reflection-type sensor 271 (i.e., Ld≥α). It is preferable that the length Ld of the position detection mark is in a range from 5 mm to 15 mm (i.e., 5 mm≤Ld≤15 mm) for ensuring that the reflection-type sensor 271 detects the position detection mark.

Next, the detection test 6 and evaluations thereof will be described. In the detection test 6, a plurality of sample belts with position detection marks having different widths Wd (FIG. 15) are prepared.

The detection test 6 is performed under the following test conditions:

(11) Each of the position detection marks (FIG. 15) of the sample belts of Examples 27 through 33 and Comparison Examples 16 and 17 has the height difference dg of approximately 5.5 μm at the mark contour portion and the height difference dc of approximately 3.2 μm at the mark center portion. The position detection mark is formed by irradiation with laser light under the same conditions as the position detection mark of the sample belt of Example 13.

The position detection marks of the sample belts of Examples 17 through 26 and Comparison Examples 14 and 15 have the same length Ld of 7 mm, but have the different width Wd in a range from 2 to 20 mm.

(12) Change with time of the difference ΔV1 is determined by the following method.

(a) In a state where the test apparatus (i.e., the image forming apparatus) is held in a horizontal orientation, the difference ΔV1 in the light reception voltage is measured when the sample belt is rotated one turn.

(b) In a state where the test apparatus is held in an inclined orientation, the sample belt is rotated 100 turns, and the difference in the light reception voltage is measured every rotation. A minimum value of the measured differences is determined as ΔV2. Then, a difference ΔV3 between the difference ΔV1 and the minimum difference ΔV2 is obtained.

In this regard, the horizontal orientation is an orientation as shown in FIG. 13. That is, a moving direction of the transfer belt 223 of the transfer belt unit 210 passing the image forming units 211 through 214 (FIG. 13) is horizontal, and an axial direction of a rotation axis of each of the photosensitive drums 251 of the image forming units 211 through 214 is also horizontal.

In contrast, the inclined orientation is an orientation such that the axial direction of the rotation axis of each photosensitive drum 251 is inclined. When the sample belt is rotated while the test apparatus is held in the inclined orientation, the sample belt meanders in one direction along the widthwise direction. Influence of meandering of the sample belt on the light reception voltage is determined when the sample belt meanders to the largest amount. That is, as the difference ΔV3 is smaller, the influence of meandering of the sample belt on detection of the position detection mark becomes smaller. As the difference ΔV3 is larger, the influence of meandering of the sample belt on detection of the position detection mark becomes larger.

(13) Results of the detection test 6 are evaluated as follows.

When the difference ΔV2 is larger than or equal to 1.0 V even in the case where the meandering amount of the sample belt is the largest (i.e., ±2 mm), the evaluation result is rated as "◎" (excellent).

When the difference ΔV2 is larger than or equal to 1.0 V but decreases in the case where the meandering amount of the sample belt is the largest, the evaluation result is rated as "○".

When the difference ΔV2 is less than 1.0V, the evaluation result is rated as "X".

When the difference ΔV1 is larger than or equal to 1.0 V but the waving of the portion where the position detection mark is formed is found, the evaluation result is rated as "□".

Other test conditions of the detection test 6 are the same as the detection test 4.

FIG. 24 shows results of the detection test 6. The detection test 6 and evaluations thereof will be described with reference to FIG. 24.

As shown in FIG. 24, when the width Wd of the position detection mark is 2 mm, the difference ΔV1 is small, and the difference ΔV3 is large. In this case, it is understood that the position detection mark is not well detected in an initial stage and at a later stage. This is because, when the width Wd of the position detection mark is the same as the light reception spot diameter α of the light receiving portion 273, the light receiving portion 273 may receive reflected light from the non-mark portion (as well as reflected light from the position detection mark) even when the sample belt slightly meanders. When the sample belt largely meanders, the light receiving portion 273 may receive reflected light from the non-mark portion at more than half of the light receiving spot (having the light reception spot diameter α), with the result that the difference ΔV2 decreases.

Figure 25:
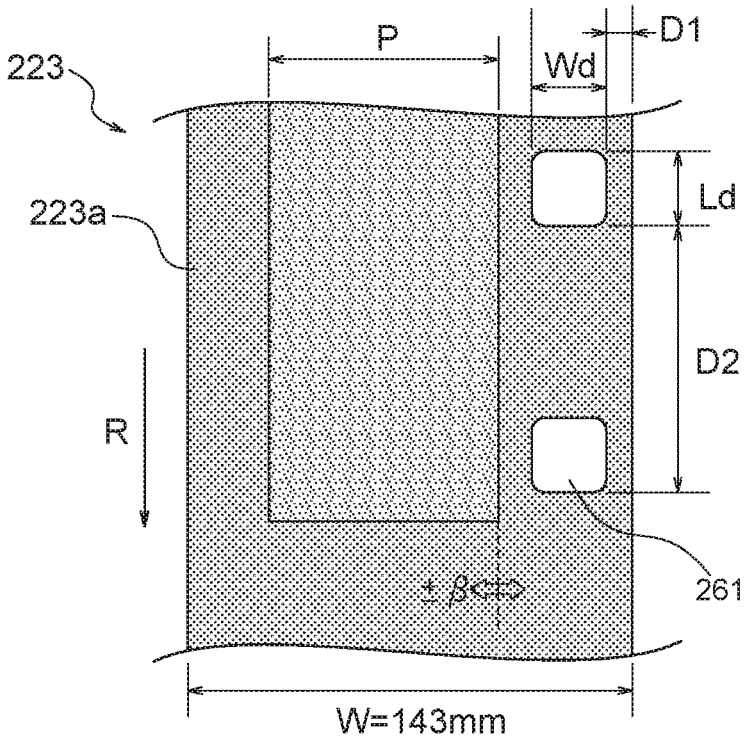
FIG. 25 is a plan view showing a part of the transfer belt according to the second embodiment, in which an arrow shows a rotating direction of the transfer belt.

In contrast, when the width Wd is larger than or equal to 4 mm, the difference ΔV1 is larger than or equal to 1.0 V, and the difference ΔV2 is also larger than or equal to 1.0 V. Therefore, the position detection mark is detectable at the later stage without any problem. However, the difference ΔV3 is 0.4 V when the width Wd is 4 mm, while the difference ΔV3 is 0.5 V when the width Wd is 5 mm. That is, the light reception voltages at the later stage are different. This is because the maximum meandering amount ±β (FIG. 25) is ±2 mm on the design. FIG. 25 shows a meandering amount when a part of the transfer belt 223 meanders by the amount ±β in the widthwise direction.

In the detection test 6, the sample belt is displaced toward one side of the sample belt by the maximum meandering amount (i.e., 2 mm) in the widthwise direction during rotation because the test apparatus is held in the inclined orientation. The light receiving portion 273 having the light reception spot diameter α receives reflected light from the non-mark portion when the sample belt meanders by the maximum meandering amount, and causes decrease in the difference ΔV2. When the width Wd is 20 mm, the position detection mark is deformed (for the same reason as described in the detection test 5), and the waving of the sample belt is found.

From these results, the width Wd of the position detection mark preferably satisfies the relationship: 2α (i.e., mm)≤Wd≤15 mm, and more preferably satisfies the relationship: α+2β≤Wd≤15 mm in order to enable detection of the position detection mark even after the transfer belt is rotated for a long time.

Next, the detection test 7 and evaluations thereof will be described. In the detection test 7, a plurality of sample belts having different distances D1 (FIG. 25) between the position detection marks and the ends of the sample belts are prepared.

The detection test 7 is performed under the following test conditions:

(14) The durability of the sample belt is examined while the test apparatus is held in the inclined orientation so that the end of the sample belt (on the same side as the position detection mark) is pressed against the flange (i.e., the meandering prevention member) with a force of 800 gf. For example, the flange is formed on an end portion of the supporting roller 220 as a driven roller (FIG. 13) in an axial direction on the same side as the position detection mark of the transfer belt 223.

(15) In each of the sample belts used in the detection test 7, the position detection mark has the length Ld of 7 mm, the width Wd of 7 mm, the height difference dg of 5.5 μm at the mark contour portion, and the height difference dc of 3.2 μm at the mark center portion. The position detection mark is formed by irradiation with laser light under the same conditions as the position detection mark of the sample belt of Example 13. The sample belt is rotated at a linear speed of 300 mm/s.

(16) When sample belt does not break for 500,000 turns, the evaluation result is rated as "○" (excellent).

When the sample belt breaks at 500,000 turns or less but does not break for 200,000 turns, the evaluation result is rated as "Δ".

When the sample belt breaks at 200,000 turns or less, the evaluation result is rated as "X" (poor).

When the position detection mark is found in a printing area of the sample belt, the evaluation result is rated as "□".

Other test conditions of the detection test 6 are the same as the detection test 4.

FIG. 26 shows results of the detection test 7. The detection test 7 and evaluation results will be described with reference to FIG. 26.

As shown in FIG. 26, when the distance D1 is 0 mm (i.e., when the position detection mark is disposed at the end of the sample belt in the widthwise direction), the sample belt breaks in an early stage before the sample belt rotates 200,000 turns in such a manner that the sample belt is teared at an edge of the position detection mark. This is considered to be because the position detection mark forms a step portion at the end of the sample belt, and a crack is generated from the step portion by sliding contact with the flange.

When the distance D1 is 0.5 mm, the sample belt breaks at the position detection mark in the early stage before the sample belt rotates 200,000 turns. This is considered to be because the sample belt is repeatedly bent at a position distanced from the end of the sample belt by approximately 0.5 mm when the end of the sample belt slidably contacts the flange. A portion where bending occurs (referred to as a bending fulcrum) is likely to break due to bending fatigue. The position detection mark formed on the bending fulcrum is considered to promote breakage due to the bending fatigue.

In contrast, when the distance D1 is larger than or equal to 1.0 mm, the durability of 200,000 turns or more is obtained. When the distance D1 is larger than or equal to 2.0 mm, the durability of 500,000 turns or more is obtained. When the distance D1 is 1.0 mm or 1.5 mm, the position detection mark is not formed on the above described bending fulcrum, but the end of the position detection mark is closer to the bending fulcrum as compared with the case where the distance D1 is larger than or equal to 2.0 mm. This is considered to be the reason why the sample belt breaks earlier as compared with the case where the distance D1 is larger than or equal to 2.0 mm.

In terms of prevention of breakage of the transfer belt, it is preferable that the distance D1 from the end of the transfer belt to the position detection mark is large. However, if the distance D1 is too large, the position detection mark may be formed in the printing area, which may result in transfer failure. Although the position detection mark can be formed outside the printing area by increasing the width W of the transfer belt, it is not preferable to increase the width W of the transfer belt in terms of downsizing.

From the above described results, the distance D1 is preferably larger than or equal to 1.0 mm, and more preferably satisfies the relationship: 2.0 mm≤D1≤W−(β+Wd+P) in order to enable the transfer belt to rotate for a long time while preventing the position detection mark from inducing breakage of the transfer belt. In this regard, W (mm) represents the width of the transfer belt, β (mm) represents the maximum meandering amount, Wd (mm) represents the size of the position detection mark in the widthwise direction, and P (mm) represents a maximum width of the printing area on the transfer belt (i.e., a maximum width of a recording medium to be used).

As described above, the transfer belt 223 of the second embodiment is configured so that the height difference dg of the contour of the position detection mark (i.e., the mark contour portion) is larger than the height difference dc of the center of the position detection mark (i.e., the mark center portion). With such a configuration, the starting point of the position detection mark can be easily detected, and therefore conveyance and positioning of the transfer belt 223 can be accurately controlled.

Further, using the light reception spot diameter α (mm) of the light receiving portion 273 of the reflection-type sensor 271 detecting the position detection mark 261, the length Ld of the position detection mark 261 in the circumferential direction of the transfer belt 223 satisfies the relationship:

$\alpha \leq Ld \leq 15$ mm. Further, using the maximum meandering amount $\pm\beta$ (mm) of the transfer belt 223 in the widthwise direction during the rotation of the transfer belt 223, the width Wd of the position detection mark 261 in the widthwise direction of the transfer belt 223 satisfies the relationship: $2\alpha$ (i.e., 4 mm)$\leq Wd \leq 15$ mm, and more preferably satisfies the relationship: $\alpha+2\beta \leq Wd \leq 15$ mm. With such an arrangement, the position detection mark 261 is detectable by a sensor (i.e., the light receiving portion 273) even after the transfer belt 223 is left for a long time or used for a long time (i.e., used for printing on a large number of recording medium).

Further, when the position detection mark 261 includes the uneven points in the form of spots formed on the outer surface of the transfer belt 223, the distance D1 from the end of the transfer belt 223 in the widthwise direction to the position detection mark 261 is preferably larger than or equal to 1.0 mm, and more preferably satisfies the relationship: 2.0 mm$\leq D1 \leq W-(\beta+Wd+P)$. With such an arrangement, it becomes possible to rotate the transfer belt for a long time without causing breakage of the transfer belt.

As described above, according to the image forming apparatus 201 of the second embodiment, the position detection mark 261 on the transfer belt 223 can be stably detected under various use conditions and environmental conditions.

In the above described embodiments, the transfer belt of the intermediate transfer type image forming apparatus has been described as an example of the belt of the present invention. However, the belt of the present invention is not limited to the transfer belt, but may be embodied as, for example, a conveying belt or a fixing belt.

While the preferred embodiments of the present invention have been illustrated in detail, it should be apparent that modifications and improvements may be made to the invention without departing from the spirit and scope of the invention as described in the following claims.

What is claimed is:

1. A belt unit comprising:

a belt having an endless shape and formed of resin; and a driving roller provided on an inner side of the belt, the driving roller rotating to cause the belt to move in a first direction, the first direction being substantially perpendicular to a widthwise direction of the belt as a second direction, wherein the belt comprises a detection target portion on an outer surface of the belt at an end of the belt in the second direction;

wherein the detection target portion includes a plurality of grooves formed on the outer surface of the belt by laser light irradiation, the plurality of grooves being elongated in a direction substantially parallel to the first direction;

wherein the belt is stretched around a plurality of rollers including the driving roller;

wherein each of the plurality of grooves is elongated in a stretching direction of the belt, and has a depth which is less than a thickness of the belt; and wherein among the plurality of grooves of the detection target portion, a groove located at a center of the detection target portion in the second direction has a length longer than a length of a groove located at an end edge of the detection target portion in the second direction.

2. The belt unit according to claim 1, wherein the belt has a single-layer structure composed of resin.

3. The belt unit according to claim 1, wherein a difference $\Delta Y$ obtained by subtracting a visual reflectance Yr of the outer surface of the belt other than the detection target portion from a visual reflectance Yp of the detection target portion satisfies:

$$\Delta Y = Yp - Yr \geq 1\%.$$

4. The belt unit according to claim 1, wherein the depth of each of the plurality of grooves is less than 2.3 times a mean particle diameter of a developer transferred to the belt.

5. The belt unit according to claim 1, further comprising:

a supporting roller provided on the inner side of the belt and applying tension to the belt; and a transfer roller that transfers a developer image to the belt.

6. An image forming apparatus comprising:

the belt unit according to claim 1;

an image forming unit that forms a developer image to be transferred to the belt;

a secondary transfer roller that secondarily transfers the developer image from the belt to a recording medium;

a detector that detects the detection target portion of the belt; and a controller that controls a rotation of the driving roller based on information of detection by the detector.

7. An image forming apparatus comprising:

the belt unit according to claim 1;

an optical sensor that receives reflection light from the detection target portion of the belt to detect the detection target portion;

wherein the optical sensor has a receiving light spot having a diameter of $\alpha$ (mm), the detection target portion has a length Ld (mm) in a circumferential direction of the belt and a width Wd (mm) in the second direction; and wherein the diameter $\alpha$, the length Ld and the width Wd satisfy the following relationships:

$$\alpha \leq Ld \leq 15 \text{ mm, and } 2\alpha \leq Wd \leq 15 \text{ mm.}$$

8. The image forming apparatus according to claim 7, wherein a height difference at an outer edge portion of the detection target portion is larger than a height difference at a center portion of the detection target portion.

9. The image forming apparatus according to claim 7, wherein a distance between the detection target portion and an end edge of the belt in the second direction is larger than 1 mm.

10. The image forming apparatus according to claim 7, wherein when a width of the belt is expressed as W (mm), a width of the recording medium is expressed as P (mm), a maximum meandering amount of the belt in the second direction during a rotation of the belt is expressed as $\beta$ (mm), and a distance between the detection target portion and an end edge of the belt in the second direction is expressed as D1 (mm), the following relationship is satisfied:

$$1.0 \text{ (mm)} \leq D1 \leq W-(\beta+Wd+P).$$

11. The image forming apparatus according to claim 7, wherein a maximum meandering amount $\beta$ (mm) of the belt in the second direction during the rotation of the belt and a width Wd of the belt in the second direction satisfy:

$$\alpha+2\beta \leq Wd \leq 15 \text{ mm.}$$

12. The image forming apparatus according to claim 7, wherein a height difference of the detection target portion is in a range from 2.0 μm to 10.2 μm.

13. The image forming apparatus according to claim 7, further comprising a plurality of image forming units arranged in the first direction, each of the plurality of image forming units forming a developer image to be transferred to the belt;

wherein a plurality of detection target portions are arranged at an equal pitch in the circumferential direction of the belt, the pitch being the same as a pitch of the image forming units.

14. The belt unit according to claim 1, wherein the detection target portion is formed on an outer circumferential surface of the belt.

15. The belt unit according to claim 1, wherein the length of the groove located at the center of the detection target portion and the length of the groove located the end edge of the detection target portion are lengths in the stretching direction of the belt.

16. The belt unit according to claim 1, wherein the detection target portion has a rounded corner.

17. The belt unit according to claim 1, further comprising a cleaning member provided so as to contact the belt, wherein when the belt moves by rotation of the driving roller, the detection target portion passes the cleaning member.

18. A belt unit comprising:

a belt having an endless shape and formed of resin; and a driving roller provided on an inner side of the belt, the driving roller rotating to cause the belt to move in a first direction, the first direction being substantially perpendicular to a widthwise direction of the belt as a second direction, wherein the belt comprises a detection target portion on an outer surface of the belt at an end of the belt in the second direction;

wherein the detection target portion includes a plurality of grooves formed on the outer surface of the belt by laser light irradiation, the plurality of grooves being elongated in a direction substantially parallel to the first direction;

wherein the belt is stretched around a plurality of rollers including the driving roller;

wherein each of the plurality of grooves is elongated in a stretching direction of the belt, and has a depth which is less than a thickness of the belt; and wherein an interval between grooves of the plurality of grooves adjacent to each other is less than or equal to double a depth of the grooves.

* * * * *